US006827424B2

(12) United States Patent
Teshigawara et al.

(10) Patent No.: US 6,827,424 B2
(45) Date of Patent: Dec. 7, 2004

(54) PRINT APPARATUS AND PRINT METHOD

(75) Inventors: Minoru Teshigawara, Kanagawa (JP); Naoji Otsuka, Kanagawa (JP); Kiichiro Takahashi, Kanagawa (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,423

(22) Filed: Oct. 30, 2001

(65) Prior Publication Data

US 2002/0070999 A1 Jun. 13, 2002

(30) Foreign Application Priority Data

Nov. 1, 2000 (JP) ..... 2000-335188

(51) Int. Cl.[7] ..... B41J 2/21; B41J 2/145; B41J 2/15

(52) U.S. Cl. ..... 347/43; 347/40

(58) Field of Search ..... 347/40, 15

(56) References Cited

U.S. PATENT DOCUMENTS

| | | | | |
|---|---|---|---|---|
| 5,604,520 A | | 2/1997 | Matsubara | 347/43 |
| 5,774,146 A | * | 6/1998 | Mizutani | 347/43 |
| 5,818,474 A | | 10/1998 | Takahashi | 347/15 |
| 6,042,212 A | | 3/2000 | Takahashi | 347/15 |
| 6,254,217 B1 | * | 7/2001 | Askeland et al. | 347/43 |
| 6,315,387 B1 | * | 11/2001 | Horikoshi | 347/40 |

FOREIGN PATENT DOCUMENTS

| | | | |
|---|---|---|---|
| EP | 0955174 | * 11/1999 | 347/43 |
| JP | 2-41421 | 2/1990 | |
| JP | 7-112534 | 5/1995 | |
| JP | 3077066 | 8/2000 | |

* cited by examiner

*Primary Examiner*—Thinh Nguyen
(74) *Attorney, Agent, or Firm*—Fitzpatrick, Cella, Harper & Scinto

(57) ABSTRACT

A print method that uses a printer apparatus based on a multi-pass printing method to reduce the unevenness of colors associated with a scanning direction, even during bidirectional color printing. For this purpose, sets of two print heads that apply cyan (C), magenta (M), and yellow (Y) inks are arranged to be symmetrical in the scanning direction so that a plurality of secondary color pixels arranged in a raster direction can be formed by changing an ink application order (C→M and M→C). Consequently, the pluralities of secondary color pixels arranged in the raster direction undergo the different ink application orders, so that the application order remains the same whether the pixels are formed during forward or backward scanning. Therefore, the unevenness of colors associated with the ink application order can be reduced.

26 Claims, 32 Drawing Sheets

Blue

BLUE

DOT ARRANGEMENT AND PRINTING DIRECTION

RASTER MASK PATTERN

| | | | | | | | |
|---|---|---|---|---|---|---|---|
| A | A | A | A | A | A | A | A |
| B | B | B | B | B | B | B | B |
| A | A | A | A | A | A | A | A |
| B | B | B | B | B | B | B | B |
| A | A | A | A | A | A | A | A |
| B | B | B | B | B | B | B | B |
| A | A | A | A | A | A | A | A |
| B | B | B | B | B | B | B | B |

FIG.21B

LANDING ORDER FOR SECONDARY COLOR (BLUE) PIXELS

| | | | | | | | | |
|---|---|---|---|---|---|---|---|---|
| ODD RASTER | C1M1 | | C1M1 | | C1M1 | | C1M1 | |
| EVEN RASTER | | C2M2 | | C2M2 | | C2M2 | | C2M2 |
| ODD RASTER | C1M1 | | C1M1 | | C1M1 | | C1M1 | |
| EVEN RASTER | | C2M2 | | C2M2 | | C2M2 | | C2M2 |
| ODD RASTER | C1M1 | | C1M1 | | C1M1 | | C1M1 | |
| EVEN RASTER | | C2M2 | | C2M2 | | C2M2 | | C2M2 |
| ODD RASTER | C1M1 | | C1M1 | | C1M1 | | C1M1 | |
| EVEN RASTER | | C2M2 | | C2M2 | | C2M2 | | C2M2 |

FIG.21C

MASK SETTING FOR FOUR-PASS PRINTING

| | MASK SETTING FOR PRINTED DOTS | SCANNING DIRECTION |
|---|---|---|
| FIRST PASS | 50% OF MASK A | FORWARD SCANNING |
| SECOND PASS | 50% OF MASK B | BACKWARD PRINTING |
| THIRD PASS | 50% OF MASK C | FORWARD SCANNING |
| FOURTH PASS | 50% OF MASK D | BACKWARD PRINTING |

50% RASTER MASK + 2-PASS FINE MASK

FIG.21D

DOT ARRANGEMENT AND PRINTING DIRECTION

STAGGERED MASK PATTERN

| | | | | | | | |
|---|---|---|---|---|---|---|---|
| A | A | A | A | A | A | A | A |
| B | B | B | B | B | B | B | B |
| A | A | A | A | A | A | A | A |
| B | B | B | B | B | B | B | B |
| A | A | A | A | A | A | A | A |
| B | B | B | B | B | B | B | B |
| A | A | A | A | A | A | A | A |
| B | B | B | B | B | B | B | B |

FIG.22B

IMPACTING ORDER FOR SECONDARY COLOR (BLUE) PIXELS

| | | | | | | | | |
|---|---|---|---|---|---|---|---|---|
| ODD RASTER | C1M1 | | C1M1 | | C1M1 | | C1M1 | |
| EVEN RASTER | | M2C2 | | M2C2 | | M2C2 | | M2C2 |
| ODD RASTER | C1M1 | | C1M1 | | C1M1 | | C1M1 | |
| EVEN RASTER | | M2C2 | | M2C2 | | M2C2 | | M2C2 |
| ODD RASTER | C1M1 | | C1M1 | | C1M1 | | C1M1 | |
| EVEN RASTER | | M2C2 | | M2C2 | | M2C2 | | M2C2 |
| ODD RASTER | C1M1 | | C1M1 | | C1M1 | | C1M1 | |
| EVEN RASTER | | M2C2 | | M2C2 | | M2C2 | | M2C2 |
| | ODD COLUMN | EVEN COLUMN | ODD COLUMN | EVEN COLUMN | ODD COLUMN | EVEN COLUMN | ODD COLUMN | EVEN COLUMN |

FIG.22C

MASK SETTING FOR FOUR-PASS PRINTING

| | MASK SETTING FOR PRINTED DOTS | SCANNING DIRECTION |
|---|---|---|
| FIRST PASS | 50% OF MASK A | FORWARD SCANNING |
| SECOND PASS | 50% OF MASK B | BACKWARD PRINTING |
| THIRD PASS | 50% OF MASK C | FORWARD SCANNING |
| FOURTH PASS | 50% OF MASK D | BACKWARD PRINTING |

50% STAGGERED MASK + 2-PASS FINE MASK

FIG.22D

DOT ARRANGEMENT AND PRINTING DIRECTION

RANDOM MASK PATTERN

| | | | | | | | |
|---|---|---|---|---|---|---|---|
| 1 | 3 | 4 | 2 | 3 | 1 | 4 | 2 |
| 2 | 4 | 3 | 1 | 4 | 1 | 2 | 3 |
| 4 | 2 | 3 | 1 | 2 | 3 | 4 | 1 |
| 4 | 1 | 2 | 3 | 2 | 1 | 3 | 4 |
| 2 | 3 | 1 | 4 | 1 | 2 | 4 | 3 |
| 2 | 4 | 1 | 3 | 2 | 4 | 3 | 1 |
| 3 | 2 | 1 | 4 | 2 | 1 | 3 | 4 |
| 1 | 3 | 2 | 4 | 3 | 2 | 1 | 4 |

FIG.23B

LANDING ORDER FOR
SECONDARY COLOR (BLUE) PIXELS

| | | | | | | | |
|---|---|---|---|---|---|---|---|
| C1M1 | | M1C1 | | C1M1 | | M1C1 | |
| | M2C2 | | C2M2 | | C2M2 | | C2M2 |
| M1C1 | | C1M1 | | M1C1 | | M1C1 | |
| | C2M2 | | C2M2 | | C2M2 | | M2C2 |
| M1C1 | | C1M1 | | C1M1 | | M1C1 | |
| | M2C2 | | C2M2 | | M2C2 | | C2M2 |
| M1C1 | | C1M1 | | M1C1 | | C1M1 | |
| | C2M2 | | C2M2 | | M2C2 | | M2C2 |

FIG.23C

MASK SETTING FOR FOUR-PASS PRINTING

| | MASK SETTING FOR PRINTED DOTS | SCANNING DIRECTION |
|---|---|---|
| FIRST PASS | 25% OF RANDOM MASK | FORWARD SCANNING |
| SECOND PASS | 25% OF RANDOM MASK | BACKWARD PRINTING |
| THIRD PASS | 25% OF RANDOM MASK | FORWARD SCANNING |
| FOURTH PASS | 25% OF RANDOM MASK | BACKWARD PRINTING |

4-PASS RANDOM MASK

FIG.23D

PRINT APPARATUS AND PRINT METHOD

This application is based on Patent Application No. 2000-335188 filed Nov. 1, 2000 in Japan, the content of which is incorporated hereinto by reference.

BACKGROUND OF THE INVENTION

1. Field of the Invention

The present invention relates to a bidirectional print apparatus and method for executing bidirectional scanning of print heads that apply ink of a plurality of colors to a print medium, and in particular, to a bidirectional print apparatus and method that can reduce the unevenness of colors which may occur during bidirectional color printing, and prints obtained by this method and apparatus.

2. Description of the Related Art

For print apparatuses, and in particular, those based on an ink jet method, it is important to increase the printing speed during color printing. General methods for increasing the printing speed include an increase in the length of print heads, an increase in the printing frequency of the print heads, and the introduction of bidirectional printing. Compared to unidirectional printing, the bidirectional printing enables required energy to be temporally distributed in order to obtain the same throughput and is thus a cost-efficient means as a total system.

However, with the bidirectional printing method, the landing order of ejected color inks differs between the forward and backward directions of main-scanning depending on the construction of the print apparatus and in particular its print heads. Thus, with this method, unevenly colored portions like bands may be created; this is a problem originating from the principle of this method. Since this problem is caused by the landing order of the ink, more or less a difference in coloring occurs if dots of different colors even partially overlap each other.

If an image is formed by ejecting coloring materials such as pigments or dye inks onto a print medium, the ink in the first printed dot first is deposited on the print medium and then permeates from the front layer to the interior thereof. When ink that forms a subsequent dot is then disposed on the first printed dot so that these dots at least partially overlap each other, a larger amount of ink is placed below an area already dyed with the first ink. Consequently, the first printed dot tends to provide more intense coloring than the subsequent dot. Thus, with a conventional construction in which nozzles for the respective colors are arranged in a main-scanning direction, when bidirectional printing is executed, the landing order of the ejected ink is reversed between the forward and backward scanning. As a result, a difference in coloring occurs to form unevenly colored portions like bands.

This phenomenon occurs not only with ink but also with wax-based coloring materials for forming process colors because of the relationship between the first and second printed dots, in spite of a difference in principle.

Ink jet printers supporting the bidirectional printing are constructed so as to avoid this problem using the following methods:

1) Uneven colors are permitted. Alternatively, only black is printed in both directions.
2) The nozzles for the respective colors are arranged in the sub-scanning direction. That is, what is called a vertical arrangement is used.
3) Forward- and backward-scanning nozzles are provided and nozzles or heads used are switched between the forward and backward scanning so as to use the same landing order for each color (Japanese Patent Application publication No. 3-77066).
4) During forward and backward scanning, rasters are printed so as to be interlaced to complementarily make the color of each printed raster uneven at a high frequency according to a difference in landing order so that the rasters eventually appear even (Japanese Patent Application Publication No. 2-41421 and Japanese Patent Application Laid-open No. 7-112534).

However, the above conventional technique 1) does not provide an essential solution and has the disadvantage of sharply reducing the throughput when a color image is input. With the vertical arrangement in 2) provides the same landing order during both the forward and backward scanning but has the disadvantage of requiring long print heads and being sensitive to a difference in coloring caused by a time difference between landing of each color.

With the method in 3), for example, the formation of forward- and backward-scanning print heads on the same substrate is equivalent to the provision of totally different print heads. Accordingly, this method has the disadvantage of creating band-like unevenly colored portions with a large color difference similar to an inter-head difference. For example, if there is a difference in temperature increase between the print heads associated with a difference in data rate between the forward and backward scanning caused by the interference among the data, a difference in the amount of ink ejected occurs between the print heads to form band-like unevenly colored portions.

This problem is serious in one-pass bidirectional printing, but a similar problem occurs with bidirectional multipass printing owing to a difference in the number of dots printed between the forward and backward printing passes, a difference in the number of dots obtained using a decimation mask for complementing data, or a difference in the number of dots printed associated the yielding of dots to printing of the rasters.

The method in 4) provides uneven colors of a high frequency to make it difficult to visually perceive the unevenness, so that depending on the type of print data, the color difference may be emphasized because of the interference among the data. For example, with an arrangement in which a color difference is created for each raster, if in a halftone portion such as screening, only even rasters are likely appear in a certain area in the forward or backward direction, while only odd rasters are likely appear in a certain area in the backward or forward direction, then a large color difference may occur even if the same color is designated.

SUMMARY OF THE INVENTION

It is an object of the present invention to provide a print apparatus and method using an ink jet printing apparatus based on what is called a multipass printing method that forms an image by executing main scanning a plurality of times in the same scanning area using different groups of nozzles, the ink jet printing apparatus being able to reduce the occurrence of uneven colors associated with a scanning direction even when bidirectional color printing is executed. The present invention also provides prints obtained by using this print apparatus and method.

It is another object of the present invention to provide a print apparatus and method that can reduce the occurrence of uneven colors associated with the scanning direction regardless of print data, as well as prints obtained using this print apparatus and method.

To attain this object, the present invention provides a print apparatus comprising print heads having a plurality of printing element rows each having a plurality of printing elements to form a color image by scanning the same scanning area a plurality of times in a forward and a backward directions using different printing element rows of the print heads to apply ink of a plurality of colors to a print medium, wherein the print heads are composed of two sets of printing element array sections each having printing element rows, the sets being sequentially arranged and ejecting different inks, the arrays of the printing element rows of the printing element array sections being set to be symmetrical in a scanning direction, and the print apparatus comprises mask means for complementarily masking predetermined rasters in a raster direction or predetermined columns in a column direction while scanning image data a plurality of times.

Further, the present invention provides a print apparatus comprising print heads having a plurality of printing element rows each having a plurality of printing elements to form a color image by scanning the same scanning area a plurality of times in a forward and a backward directions using different printing element rows of the print heads to apply ink of a plurality of colors to a print medium, wherein the print head are composed of two sets of printing element array sections each having printing element rows, the sets being sequentially arranged and ejecting different inks, the arrays of the printing element rows of the printing element array sections being set to be symmetrical in a scanning direction, and the print apparatus comprises change means for changing an ink application order for at least one of a plurality of secondary color pixel areas arranged in a column direction, compared to an ink application order for the other secondary color pixel areas, to form said secondary color pixel area, and mask means for complementarily masking predetermined rasters in a raster direction or predetermined columns in the column direction while scanning image data a plurality of times.

Furthermore, the present invention provides a print apparatus comprising print heads having a plurality of printing element rows each having a plurality of printing elements to form a color image by scanning the same scanning area a plurality of times in a forward and a backward directions using different printing element rows of the print heads to apply ink of a plurality of colors to a print medium, wherein the print heads are composed of two sets of printing element array sections each having printing element rows, the sets being sequentially arranged and ejecting different inks, the arrays of the printing element rows of the printing element array sections being set to be symmetrical in a scanning direction, and the print apparatus comprises mask means for complementarily masking predetermined rasters in a raster direction or predetermined columns in a column direction while scanning image data a plurality of times.

Moreover, the present invention provides a print method comprising print heads having a plurality of printing element rows each having a plurality of printing elements to form a color image by scanning the same scanning area a plurality of times in a forward and a backward directions using different printing element rows of the print heads to apply ink of a plurality of colors to a print medium, wherein the print heads are composed of two sets of printing element array sections each having printing element rows, the sets being sequentially arranged and ejecting different inks, the arrays of the printing element rows of the printing element array sections being set to be symmetrical in a scanning direction, and the print method comprises a mask step of complementarily masking predetermined rasters in a raster direction or predetermined columns in a column direction while scanning image data a plurality of times.

Furthermore, the present invention provides a print method comprising print heads having a plurality of printing element rows each having a plurality of printing elements to form a color image by scanning the same scanning area a plurality of times in a forward and a backward directions using different printing element rows of the print heads to apply ink of a plurality of colors to a print medium, wherein the print heads are composed of two sets of printing element array sections each having printing element rows, the sets being sequentially arranged and ejecting different inks, the arrays of the printing element rows of the printing element array sections being set to be symmetrical in a scanning direction, and the print method comprises a change step of changing an ink application order for at least one of a plurality of secondary color pixel areas arranged in a column direction, compared to an ink application order for the other secondary color pixel area, to form said secondary color pixel area, and a mask step of complementarily masking predetermined rasters in a raster direction or predetermined columns in a column direction while scanning image data a plurality of times.

With the above arrangement, a plurality of pixel areas arranged in the raster direction and intended for a process color, containing a secondary color, predominantly undergoes the changed application order of the plurality of inks. Accordingly, whether the pixel areas are formed during the forward or backward scanning, the application order does not significantly vary in the raster direction, thereby reducing the occurrence of uneven colors associated with the ink application order.

Further, for multipass printing, by using a mask pattern to apply the change in ink application order to the column direction as well as the raster direction, the occurrence of uneven colors associated with the ink application order can be reduced in both the column and raster directions whether the pixel areas are formed during forward or backward scanning.

Here, the "print medium" is not limited to paper, used in common print apparatuses, but also means a material that can receive ink, such as a cloth, a plastic film, and a metallic plate.

Further, the "ink" should be broadly interpreted in the same manner as the definition of the "print", and means coloring materials that can be used to form images, patterns, and the like or process the print medium when applied to the surface thereof.

Furthermore, the "pixel area" means the smallest area that represents a primary or secondary color when one or more inks are applied thereto, and includes superpixels and subpixels as well as pixels. Moreover, the number of scanning operations required to complete the pixel area is not limited to one, but a plurality of scanning operations can be performed for this purpose.

Furthermore, the "process color" contains a secondary color and is obtained by mixing three or more inks together on the print medium.

The above and other objects, effects, features and advantages of the present invention will become more apparent from the following description of embodiments thereof taken in conjunction with the accompanying drawings.

BRIEF DESCRIPTION OF THE DRAWINGS

FIGS. 21A to 21D are schematic views showing raster masks and the like used in a first variation of the embodiment;

FIGS. 22A to 22D are schematic views showing staggered masks and the like used in a second variation of the embodiment; and FIGS. 23A to 23D are schematic views showing random masks and the like used in a third variation of the embodiment.

DETAILED DESCRIPTION OF PREFERRED EMBODIMENTS

An embodiment of the present invention comprises a means for providing such control as ensures that dots of at least different colors predominantly appear at substantially the same rate during both the forward and backward printing in order to form a pixel composed of a combination of these dots. In a preferred construction of a print apparatus for achieving this concept, printing elements for respective colors are arranged in the main-scanning direction so as to form pixels. Furthermore, in this form, if one-pass printing is executed using symmetrical heads for bidirectional printing, bidirectional multipass printing can be effectively executed using the symmetrical heads for bidirectional printing or well-known heads having printing elements for respective colors arranged in the main-scanning direction. However, the present invention is not limited to these heads as long as the concept of the present invention is realized.

The above form can be effectively used for a half tone area of a color image, and in particular, on a low density portion thereof. However, it is effective on a high density portion to form one pixel using a plurality of dots of at least one of the color inks and to provide a means for ensuring that to form a secondary or higher color, the component colors are predominantly provided so that the landing orders in forward and backward printing are symmetrical.

Figure 3:
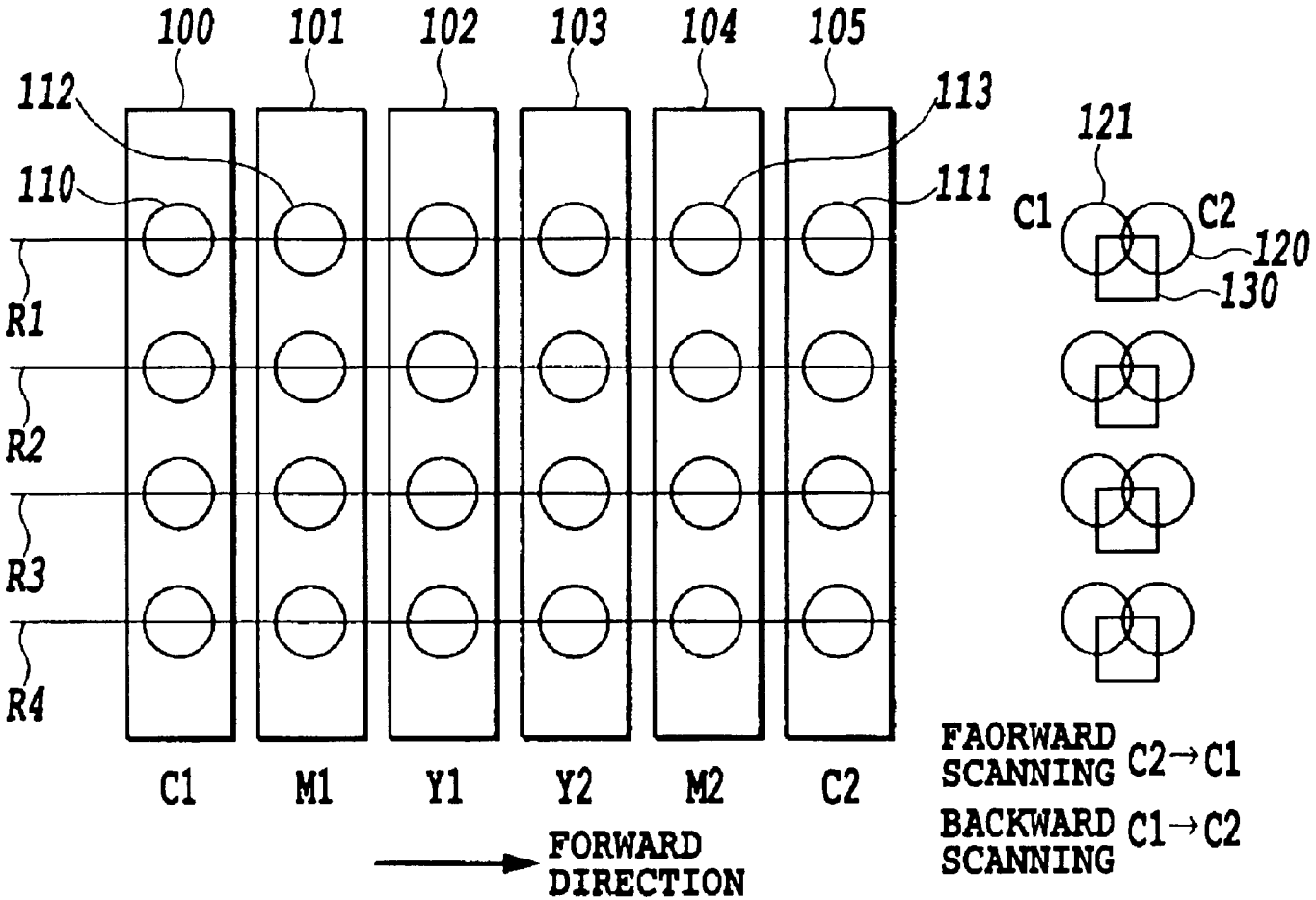
FIG. 3 is a view showing a configuration of print heads and nozzles and an arrangement of pixels according to a first basic construction of the embodiment of the present invention.

In this case, the symmetrical print head for the bidirectional printing is constructed so that for example, if the print head is arranged symmetrically when print nozzles for respective colors are viewed at least relative to the main-scanning direction as shown in FIG. 3, ink is ejected to the surface of a print medium through nozzles for relevant colors so that landing orders for the colors are symmetrical with respect to each pixel.

When a print head constructed as described above is used for printing, if a process color, containing a secondary color, is to be formed for each pixel, ink is ejected through a plurality of nozzles for at least one of the primary colors. Further, the nozzles are arranged so that the landing orders in forward and backward scanning are symmetrical as viewed relative to the main-scanning direction. This prevents the yielding of dots to geometric data such as horizontal ruled lines which may occur in conventional examples, and eliminates a difference in coloring occurring in a high-density area owing to a difference in the landing order. Furthermore, the unevenness of the colors occurring during bidirectional printing in a half tone area or a low-density area and mainly caused by the yielding of dots to halftoning such as dither can be improved by providing such control as ensures that dots of at least different colors predominantly appear at substantially the same rate during both the forward and backward printing in order to form a pixel composed of a combination of these dots.

An embodiment of the present invention will be described below in detail with reference to the drawings. In each figure, elements denoted by the same reference numeral show the same or corresponding elements.

[Basic Construction of the Embodiment of the Present Invention]

Figure 1:
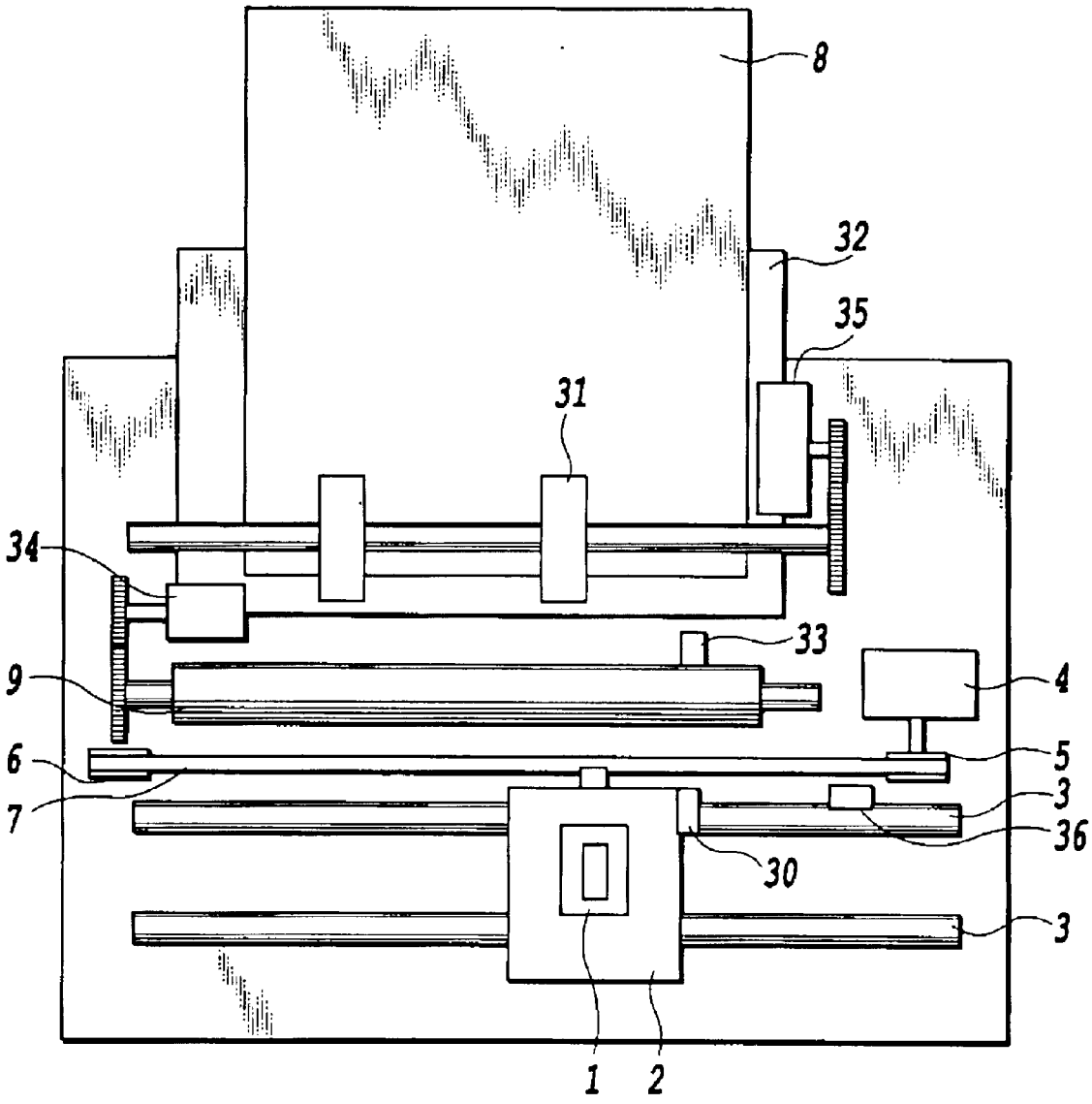
FIG. 1 is a view showing the basic construction of a main mechanism section of an embodiment of an ink jet print apparatus applied to the present invention.

FIG. 1 is a view showing the basic construction of a main mechanism section of an embodiment of an ink jet print apparatus to which the present invention has been applied.

In FIG. 1, a head cartridge 1 is replaceably mounted in a head carriage 1. The head cartridge 1 has a print head section and an ink tank section, and has a connector (not shown) disposed therein for receiving a signal for driving the head section and other signals.

The head cartridge 1 is positioned and replaceably mounted in the carriage 1. The carriage 1 has a connector holder (electric connection section) disposed therein for transmitting a drive signal or other signals to the head cartridge 1 via the connector.

The carriage 2 is guided and supported so as to reciprocate along a guide shaft 3 extending in the main-scanning direction and installed in the apparatus main body. The carriage 2 is driven by drive mechanisms such as a motor pulley 5, a driven pulley 6, and a timing belt 7, and has its position and movement controlled thereby. Further, a home position sensor 30 is provided on the carriage. Thus, when the home position sensor 30 on the carriage 2 passes by the location of an interruption plate 36, this location can be detected.

Print media 8 such as print sheets or thin plastic sheets are each separated and fed by an auto sheet feeder (hereinafter referred to as an "ASF") when pickup rollers 31 are rotated by a sheet feeding motor 35 via a gear. Furthermore, as a transportation roller 9 is rotated, the print medium 8 is transported (sub-scanning) by passing through a location (print section) opposite to a nozzle surface of the head cartridge 1. The transportation roller 9 is moved via a gear as an LF motor 34 is rotated. Then, once the print medium 8 passes by a paper end sensor 33, it is determined whether the print medium 8 has been correctly fed, and a leading position is confirmed. The paper end sensor 33 is also used to determine where the trailing end of the print medium 8 is and to finally determine the current printing position on the basis of the actual trailing end.

The print medium 8 has its back surface supported by a platen (not shown) so as to form a flat print surface in the print section. In this case, the head cartridge 1 mounted in the carriage 2 has a nozzle surface projecting downward from the carriage 2 so as to be parallel with the print medium 8 between the two transportation rollers.

The head cartridge 1 is, for example, an ink jet cartridge that ejects ink using thermal energy and that comprises an electrothermal converter for generating thermal energy. That is, the print head 1 of the head cartridge executes printing by ejecting ink through the nozzles using the pressure of bubbles resulting from film boiling caused by thermal energy applied by the electrothermal converter. Of course, other methods may be used, including the use of piezoelectric elements for ink ejection.

Figure 2:
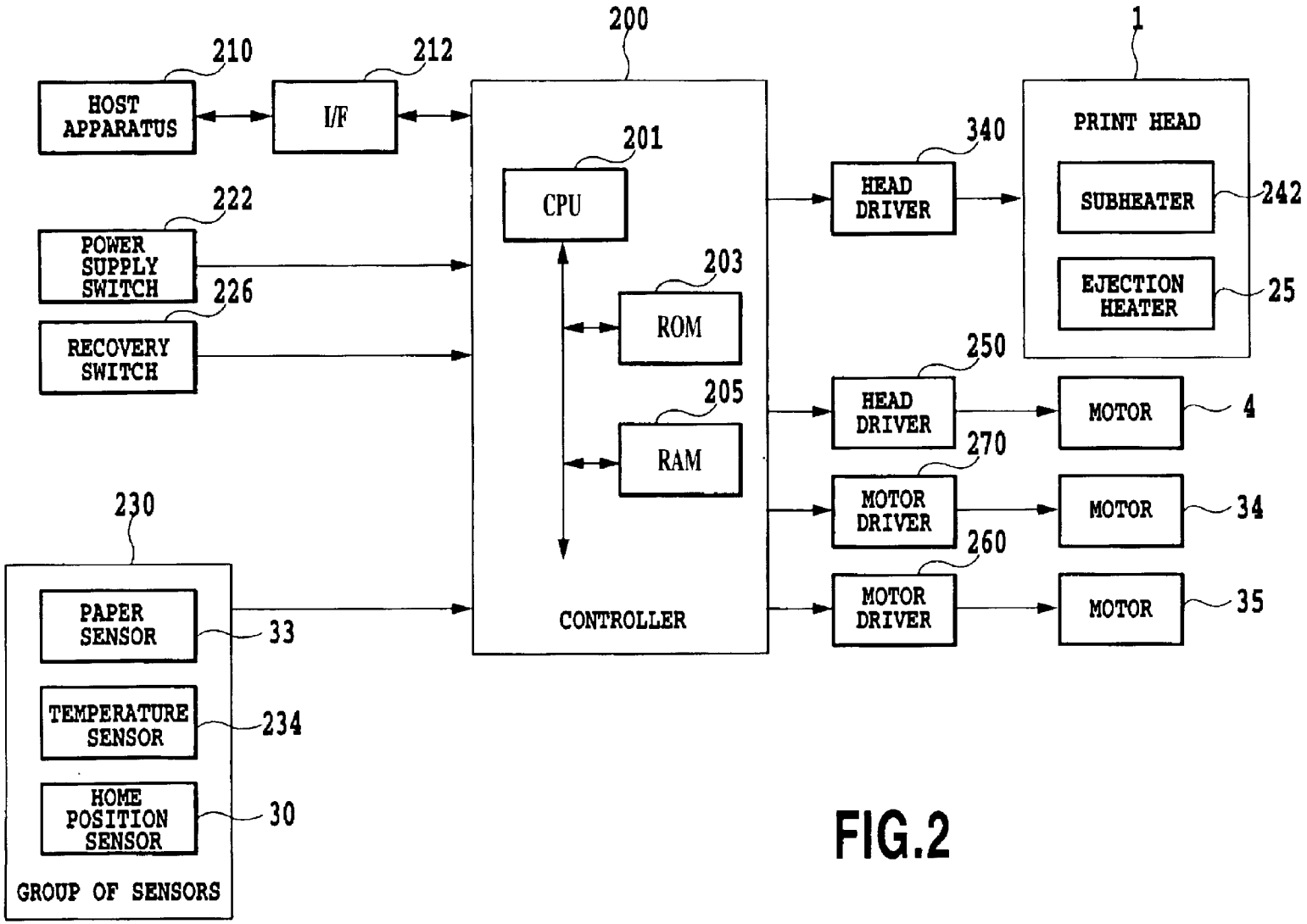
FIG. 2 is a block diagram schematically showing the configuration of a control circuit of the print apparatus.

FIG. 2 is a block diagram schematically showing an example of a configuration of a control circuit in the ink jet printing apparatus.

In this figure, a controller 200 is a main control section having a CPU 201 in the form of, for example, a microcomputer, a ROM 203 storing programs, required tables, and other fixed data, and a RAM 205 having areas in which image data is expanded, work areas, and other areas. A host apparatus 210 is a source of image data (it may be in the form of a computer that creates and processes data such as images for printing and executes other processes, a reader section that reads images, or the like). Image data, commands, status signals, and the like are transmitted to and received from the controller 200 via an interface (I/F) 212.

An operation section 120 comprises a group of switches that receive instructions input by an operator, including a power supply switch 222 and a recovery switch 126 used to instruct suction recovery to be activated.

A group of sensors 230 detect the status of the apparatus and includes the home position sensor 30 and the paper end sensor 33 for detecting the presence of a print medium, both of which have been described above, and a temperature sensor 234 provided at an appropriate location to detect an environmental temperature.

A head driver 240 drives ejection heaters 25 in the print head 1 according to print data or the like. A head driver 240 has a shift register that aligns print data with the locations of the ejection heaters 25, a latch circuit that executes latching with appropriate timings, and logic circuit elements that activate the ejection heaters synchronously with drive timing signals, as well as a timing setting section that appropriately sets drive timings (ejection timings) so as to obtain aligned dot formed locations.

The print head 1 has subheaters 242 provided therein. The subheaters 242 are used to adjust temperature in order to stabilize the ejection charateristic of ink, and may be formed on a print head substrate simultaneously with the ejection heaters 25 and/or may be mounted in the print head main body or the head cartridge.

A motor driver 250 drives a main-scanning motor 4. A sub-scanning motor 34 is used to transport the print medium 8 (sub-scanning), and a motor driver 270 drives this motor.

A sheet-feeding motor 35 is used to separate and feed the print medium 8 from the ASF, and a motor driver 260 drives this motor.

[First Basic Construction]

FIG. 3 is a schematic view partially showing the first basic construction of an essential part of the print head section of the head cartridge 1. In this figure, reference numeral 100 denotes a first print head (hereinafter referred to as "C1") that ejects cyan. Reference numeral 101 denotes a first print head (hereinafter referred to as "M1") that ejects magenta. Reference numeral 102 denotes a first print head (hereinafter referred to as "Y1") that ejects yellow. Reference numeral 103 denotes a second print head (hereinafter referred to as "Y2") that ejects yellow. Reference numeral 104 denotes a second print head (hereinafter referred to as "M2") that ejects magenta. Reference numeral 105 denotes a second print head (hereinafter referred to as "C2") that ejects cyan.

The above group of print heads constitute the head cartridge 1. In the head cartridge 1, these print heads each have a plurality of nozzles. For example, in the print head 100C1, reference numeral 110 denotes a nozzle for cyan. In the print head 101M1, reference numeral 112 denotes a nozzle for magenta. In the print head 104M1, reference numeral 113 denotes a nozzle for magenta. In the print head 105C2, reference numeral 111 denotes a nozzle for cyan.

The group of nozzles in each of the print heads are arranged in a direction generally perpendicular to the main-scanning direction. Strictly speaking, the print heads may be arranged slightly obliquely relative to the main-scanning direction in order to accommodate ejection timings. Furthermore, the groups of print heads are arranged in the main-scanning direction. Specifically, in FIG. 2, the heads 100C1, 101M1, 102M1, 103Y2, 104M2, and 105C2 are arranged in the main-scanning direction.

In this figure, dot positions 120 and 121 show where a dot ejected through the nozzle 110 of the print head 100C1 and a dot ejected through the nozzle 111 of the print head 105C2 are arranged in the area of a pixel 130. In this case, the dot position 120 shows an upper right diagonal position of the figure, whereas the dot position 121 shows an upper left diagonal position thereof. Further, reference characters R1 to R4 denote main-scanning lines forming each pixel, that is, rasters. Here, one raster, that is, one scanning operation forms one pixel.

The example shown in FIG. 3 shows that the primary color of cyan is printed as a pixel with a maximum density. The dot positions 120 and 121 are printed on the pixel 130 as a pair. In this case, if the direction shown by an arrow in the figure and in which the head cartridge 1 is moved is defined as forward, then in the forward direction, a dot from the print head 105C2 and then a dot from the print head 100C1 land on the pixel 130. In the backward direction, a dot from the print head 100C1 and then a dot from the print head 105C2 land on the pixel 130. However, in the case of the primary color, the same color lands on the pixel in both directions, so that there will be no difference in coloring associated with the landing order.

Figure 4:
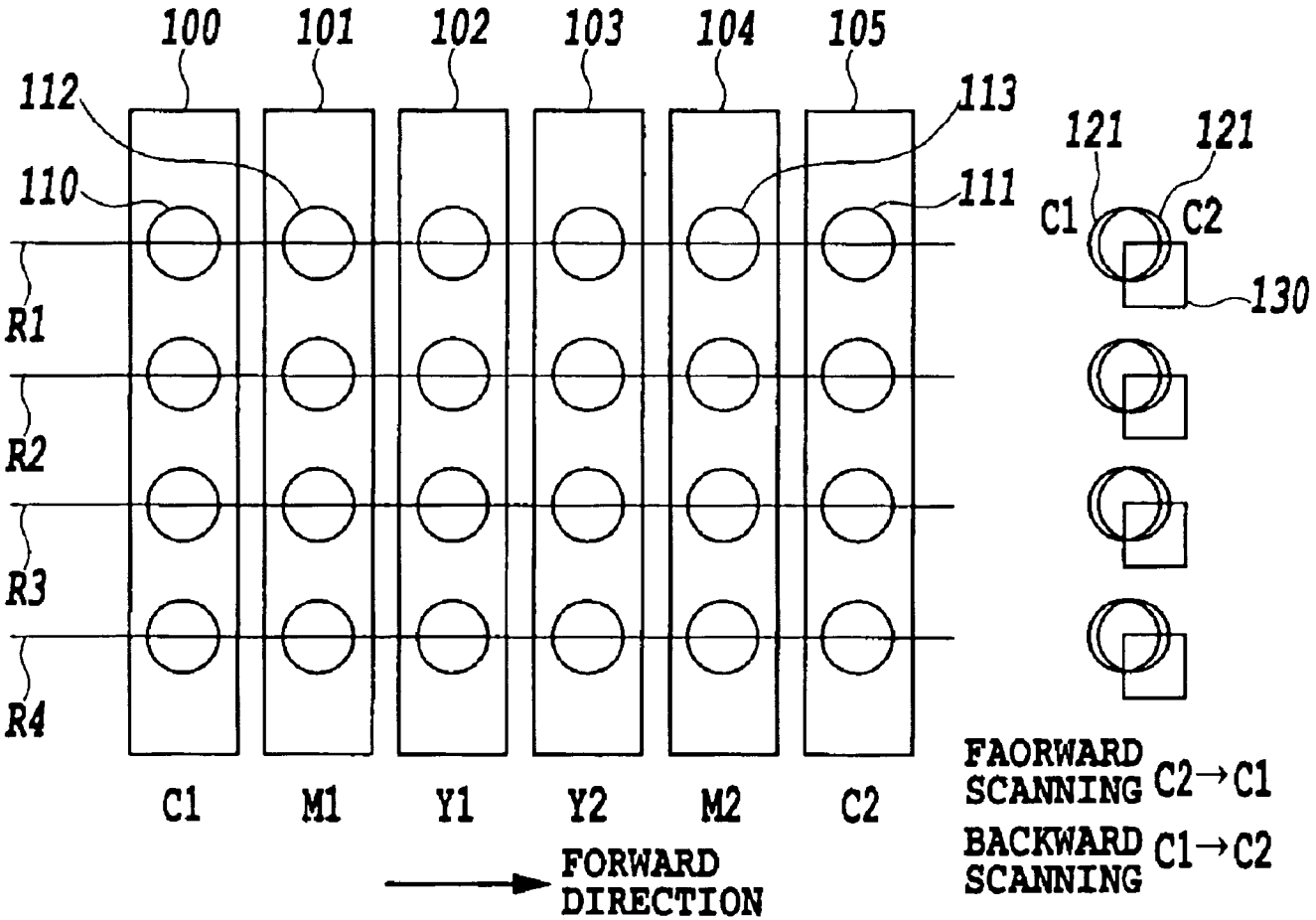
FIG. 4 is a view showing another example of the configuration of the print heads and nozzles and the arrangement of the pixels.

FIG. 4 shows that two dots are arranged at the dot position 121 on the pixel 130 with the maximum density using the head cartridge 1 constructed in the same manner as in FIG. 3. In this case, in contrast to the arrangement of the pixel 130 in FIG. 3, the dots substantially overlap each other to form a dot on dot arrangement, in which the first printed dot provides the most intense coloring. Also in this case, since the dots of the same primary color are arranged, no difference in coloring occurs between the forward and backward directions.

Figure 5:
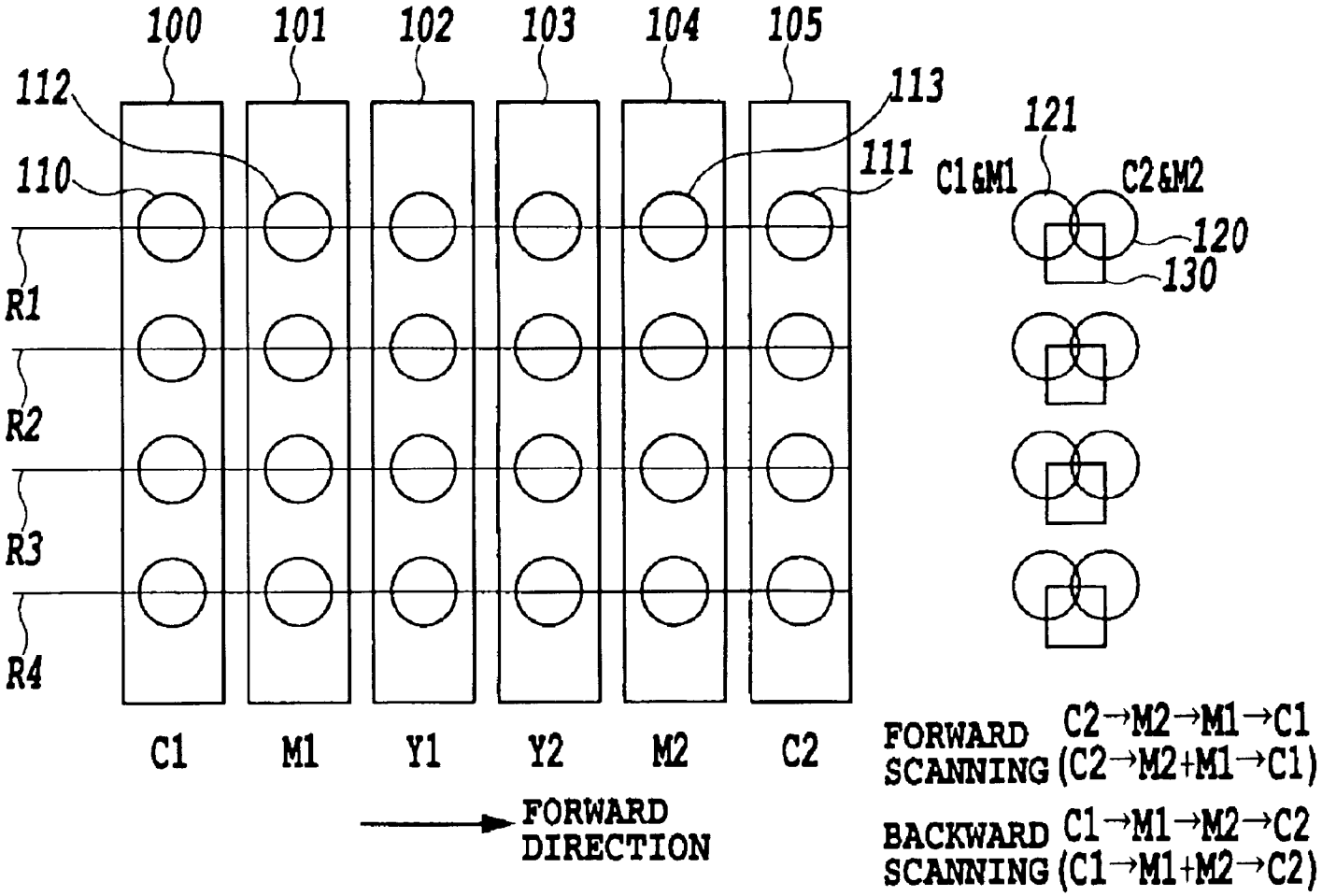
FIG. 5 is a view showing yet another example of the configuration of the print heads and nozzles and the arrangement of the pixels.

FIG. 5 shows that a cyan and a magenta dots are arranged at the dot positions 120 and 121 on the pixel 130 with the maximum density using the head cartridge 1 constructed in the same manner as in FIG. 3. In this case, in contrast to the arrangement of the pixel 130 in FIG. 3, the inks of the respective colors form a dot on dot arrangement on the corresponding pixel arrangement. For example, if blue is expressed as a secondary color, cyan and magenta are used, and with respect to the dot position 121, in the forward direction, dots from the magenta nozzles 112 of the print head 101M1 and then dots from the cyan nozzles 110 of the print head 101C1 land on the print medium. According to the above-described principle, the dot position 121 normally tends to appear reddish purple because of the predominant coloring of the magenta ink, ejected before the cyan ink.

Similarly, with respect to the dot position 120, in the forward direction, dots from the cyan nozzles 111 of the print head 105C2 and then dots from the magenta nozzles 113 of the print head 104M2 land on the print medium. According to the above-described principle, the dot position 120 normally tends to appear bluish purple because of the predominant coloring of the cyan ink, ejected before the magenta ink.

Then, printing in the backward direction will be considered. Dots from the cyan nozzles 110 of the print head 100C1 and then dots from the magenta nozzles 112 of the print head 101M1 land on the print medium. The dot position 121 normally tends to appear bluish purple because of the predominant coloring of the cyan ink, ejected before the magenta ink. Likewise, with respect to the dot position 120, in the forward direction, dots from the magenta nozzles 113 of the print head 104M2 and then dots from the cyan nozzles 111 of the print head 105C2 land on the print medium. The dot position 120 normally tends to appear reddish purple because of the predominant coloring of the magenta ink, ejected before the cyan ink.

As described above, the pair of the blue dot tending to appear reddish purple and the blue dot tending to appear bluish purple are always used. From a microscopic viewpoint, the dots with different coloring are alternately arranged in the respective columns. Form a macroscopic viewpoint, in the forward direction, the dots are applied to the pixel 130 in the order of the cyan dot from the head C2, the magenta dot from the head M2, the magenta dot from the head M1, and the cyan dot from the head C1. In the backward direction, the dots are applied to the pixel 130 in the order of the cyan dot from the head C1, the magenta dot from the head M1, the magenta dot from the head M2, and the cyan dot from the head C2. Thus, with this pixel arrangement, the landing orders in the forward and backward scanning are symmetrical. Consequently, for each pixel, even intermediate blue can be obtained.

As described above, in implementing the present invention, it is important to ensure that the colors forming the secondary color constituting a pixel predominantly land on the pixel in a symmetrical order between the forward and backward printing in order to obtain the maximum density of the pixel. In this example, the secondary color is illustrated as blue (cyan and magenta), but it is easily appreciated that the above description also applies to red (magenta and yellow) or green (cyan and yellow). Furthermore, it is easily appreciated that even for the process color, composed of a secondary or higher color, similar effects are obtained if the colors forming the process color land on the pixel in a symmetrical order.

Figure 6:
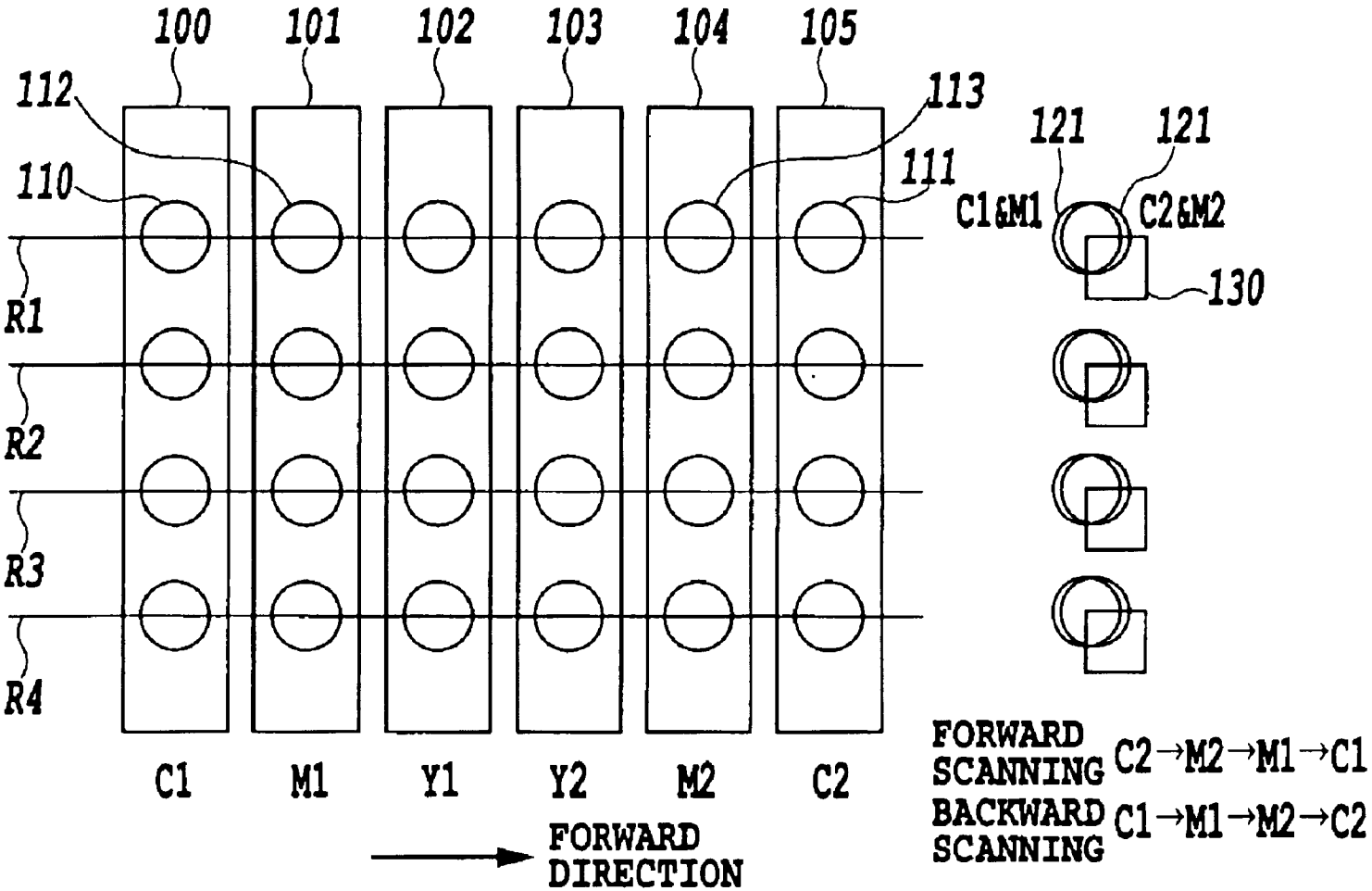
FIG. 6 is a view showing still another example of the configuration of the print heads and nozzles and the arrangement of the pixels.

FIG. 6 shows that a cyan and a magenta dots are arranged at the dot position 121 on the pixel 130 using the head cartridge 1 constructed in the same manner as in FIG. 3. In this case, the inks of the respective colors form a dot on dot arrangement on the pixel arrangement.

With respect to the dot position 121, in the forward direction, dots from the cyan nozzles 111 of the print head 105C2, then dots from the magenta nozzles 113 of the print head 104M2, then dots from the magenta nozzles 112 of the print head 101M1, and finally dots from the cyan nozzles 110 of the print head 101C1 land on the print medium. In the backward direction, cyan dots from the print head C1, then magenta dots from the print head M1, then magenta dots from the print head M2, and finally cyan dots from the print head C2 land on the print medium. Thus, with this pixel arrangement, the color landing orders in the forward and backward scanning are symmetrical. Consequently, for each pixel, even blue can be obtained.

Again, it is important to ensure that the colors forming the secondary color constituting a pixel predominantly land on the pixel in a symmetrical order between the forward and backward scanning in order to obtain the maximum density of the pixel.

Figure 7:
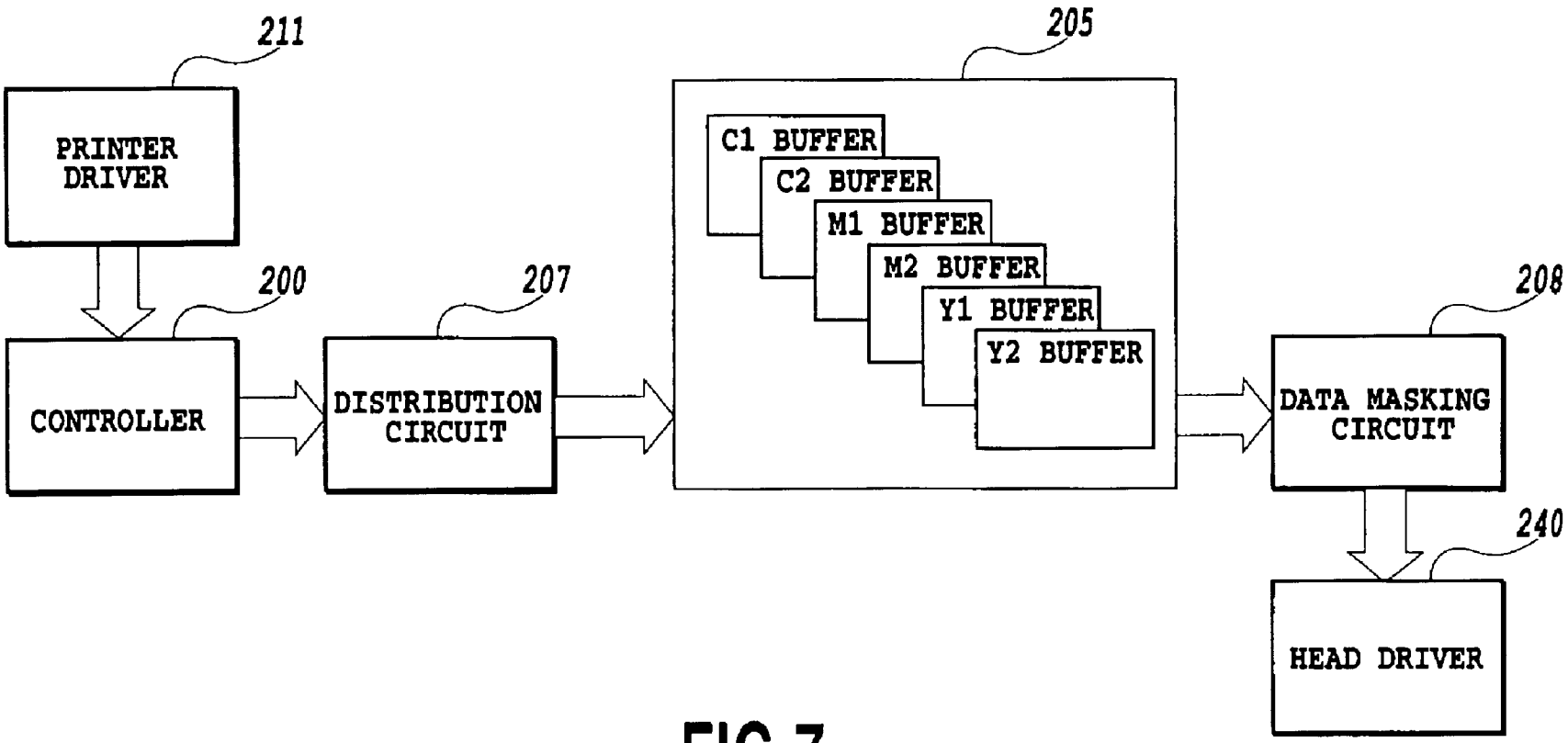
FIG. 7 is a block diagram showing a configuration of buffers for print data according to the embodiment of the present invention.

FIG. 7 is a view showing a configuration of data buffers of the print apparatus according to this embodiment.

In this figure, a printer driver 211 creates image data in the host apparatus 210 in FIG. 2 and transfers the created data to the print apparatus according to a program. A controller 200 expands the image data provided by the printer driver 211, as required, and then delivers it to a distribution circuit 207 as data expressing each of C, M, and Y with two bits. The distribution circuit 207 writes the CMY data to the print buffer 205 in accordance with the correspondence table shown in FIGS. 9A to 9C, described later.

In this case, it is assumed that for example, 2-bit data is written for cyan. At this time, with the method of this embodiment, one bit is written to each buffer 205C1, 205C2 for the print head 100C1, 105C2, respectively, in order to achieve the maximum density. When the print head reaches a predetermined location in a pixel on which dots are actually printed, the data on the corresponding buffer is read into a register in the corresponding print head to perform a printing operation. With such data and a buffer configuration, different print heads can print dots on a subpixel using the 2-dot pair. In this embodiment, the three colors CMY have been illustrated, but the above description also applies to the use of four colors CMYK, shades, or other color inks.

Print buffers 205C1, C2, M1, M2, Y1, and Y2 are provided in the RAM 205, shown in FIGS. 2 and 7.

The reproduction of the maximum density for each pixel has been principally described, but an explanation will be given of the reproduction of bidirectional printing in the case in which a half tone is reproduced within a pixel. Here, a specific example will be given in which multivalued data is received.

In this embodiment, unless otherwise specified, data expressing each color with two bits and three values (the number of dots corresponds to zero, one, or two) for each pixel is received and reproduced. Of course, the number of bits is not limited to two, but multiple bits such as four bits may be used. Furthermore, even with the 2-bit data form, two values alone may be used. In particular, the number of bits depends on design concepts including the relationship between the printing resolution and the diameter of dots or the level of the gradient or maximum density for each pixel. Accordingly, any number can be used without deviating from the spirits of the present invention.

If a half tone is reproduced within a pixel, dots cannot be arranged on the pixel using the above-described 2-dot pair because the 2-dot pair expresses the maximum density. In the embodiment of the present invention, if the 2-dot pair is not used in arranging dots, the colors constituting a half tone may each be composed of one dot. As a result, when a secondary color is reproduced using the forward and backward scanning, the coloring may vary owing to the osmotic pressure, according to the principle described for the conventional example.

In this embodiment, control is provided such that pixels undergoing different color landing orders between the forward and backward printing appear at substantially the same rate during both the forward and backward scanning, thereby providing the same coloring during both the forward and backward scanning from a macroscopic viewpoint. This embodiment is characterized by using a print head having nozzles for respective colors arranged so that the landing orders in the forward and backward directions are symmetrical with respect to the main-scanning direction. That is, this embodiment is characterized in that the landing order can be changed within the same print scanning by selecting either of two printing nozzles for the same color arranged in the main-scanning direction.

Print data expanded in the above-described print buffers is masked by a masking circuit 208 and then transferred to the head driver.

Figure 8:
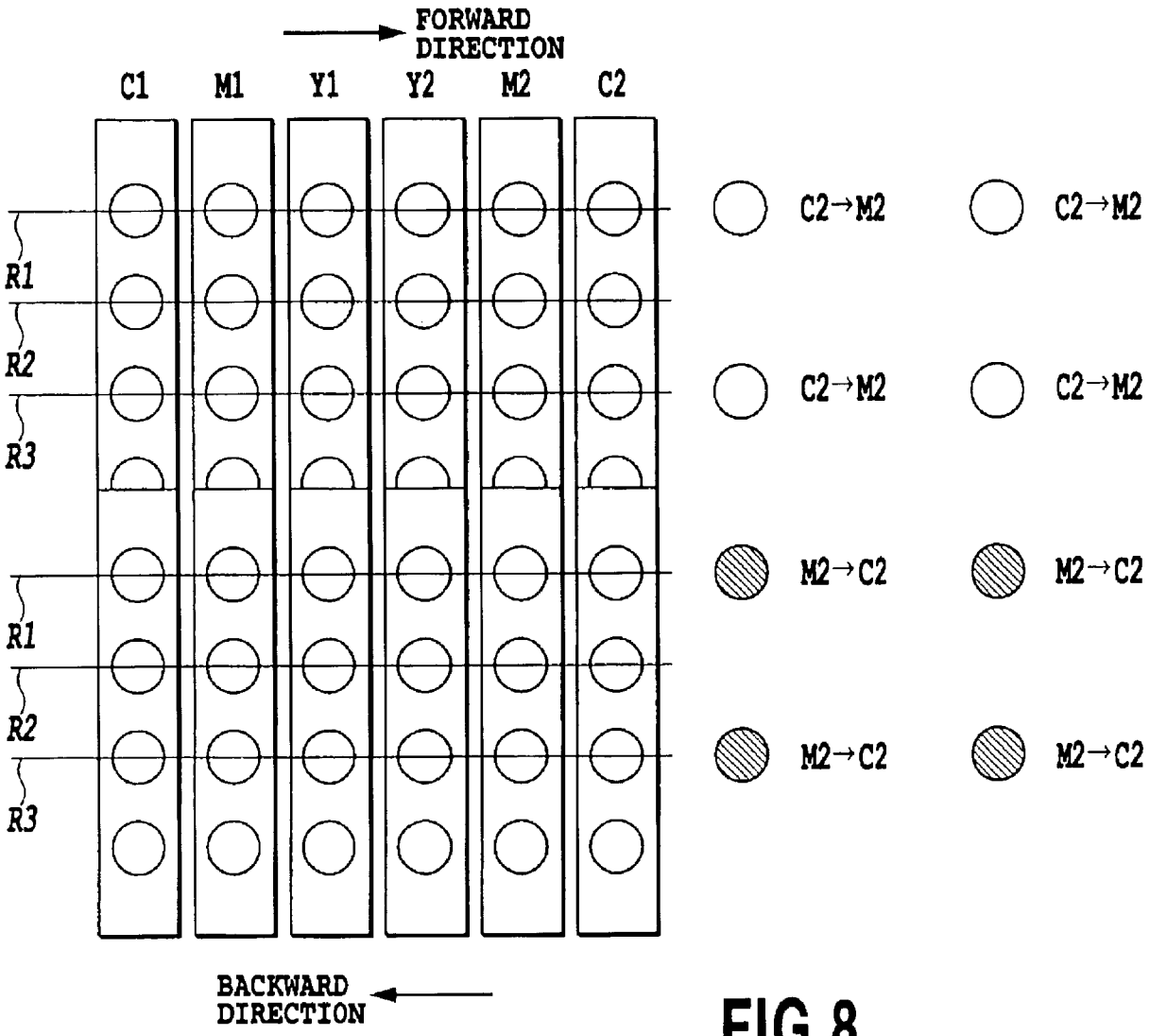
FIG. 8 is a view showing how print data is affected by forward or backward scanning in a conventional example.

FIG. 8 shows a conventional example of the yielding of print nozzles used associated with the yielding of print data to the positions of the print nozzle rows during bidirectional printing. As seen in the figure, when blue (cyan and magenta) is formed, dots undergoing the same landing order occur in each of the forward and backward directions. Since these landing orders differ from one another, a band-like unevenly colored portion occur in the scanning direction.

Figure 9A:
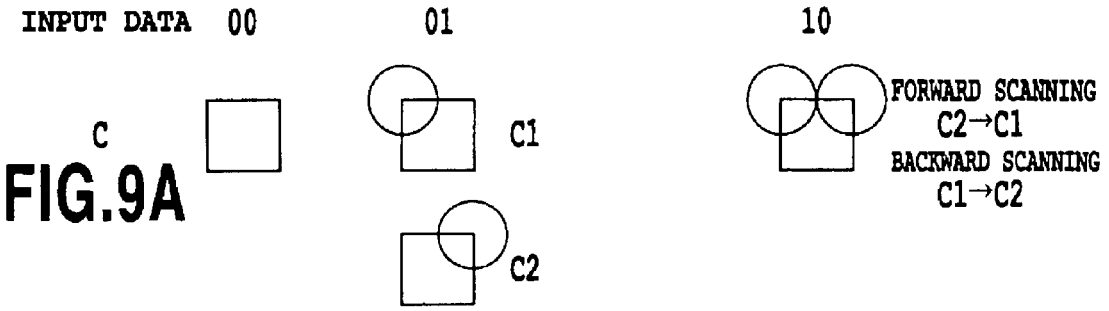
FIGS. 9A to 9C are views showing the relationship between input data used in the first basic construction of the embodiment of the present invention and the positions of arranged dots.
Figure 9B:
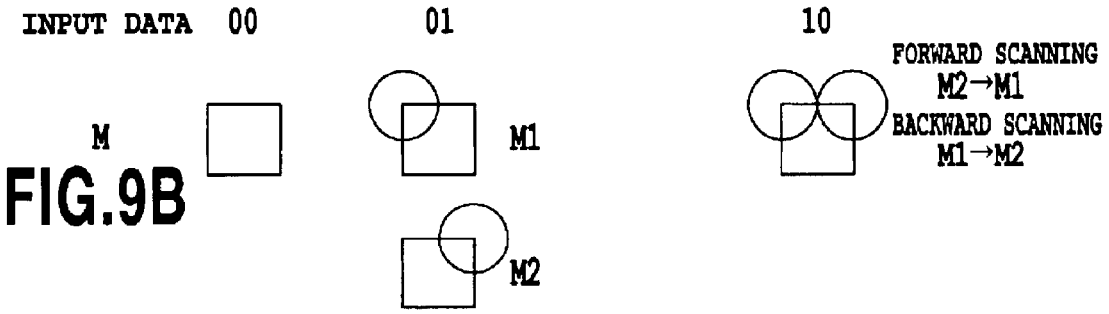
Figure 9C:
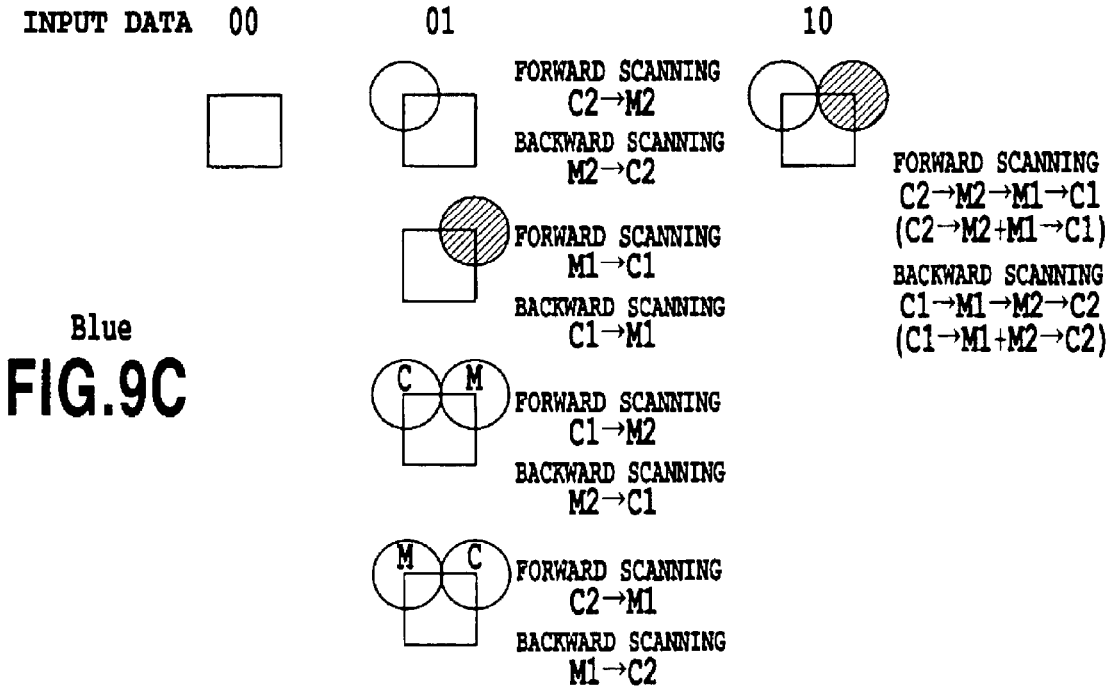
Figure 10:
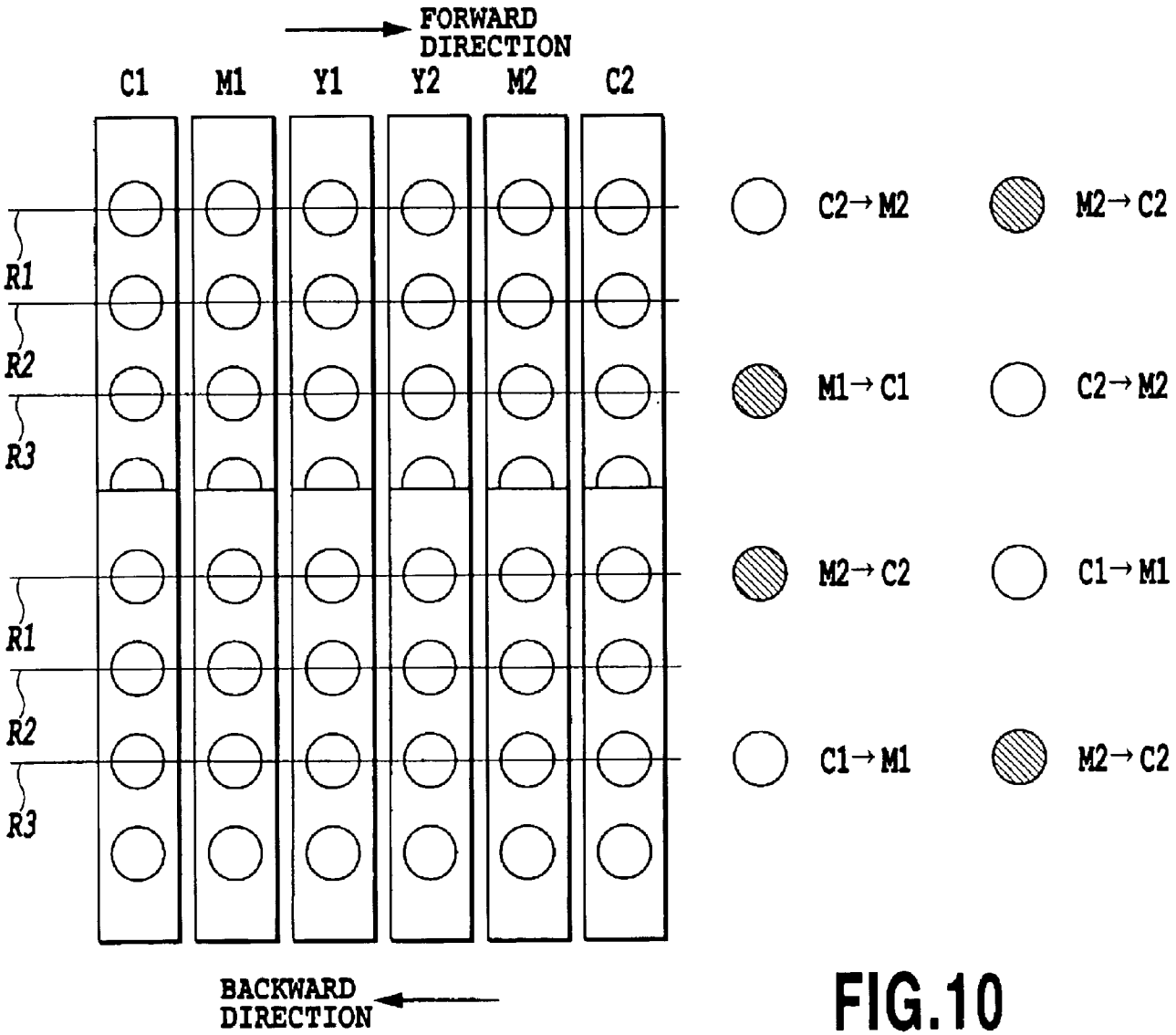
FIG. 10 is a view showing how a low-density area is printed using the first basic construction of the embodiment of the present invention.
Figure 11:
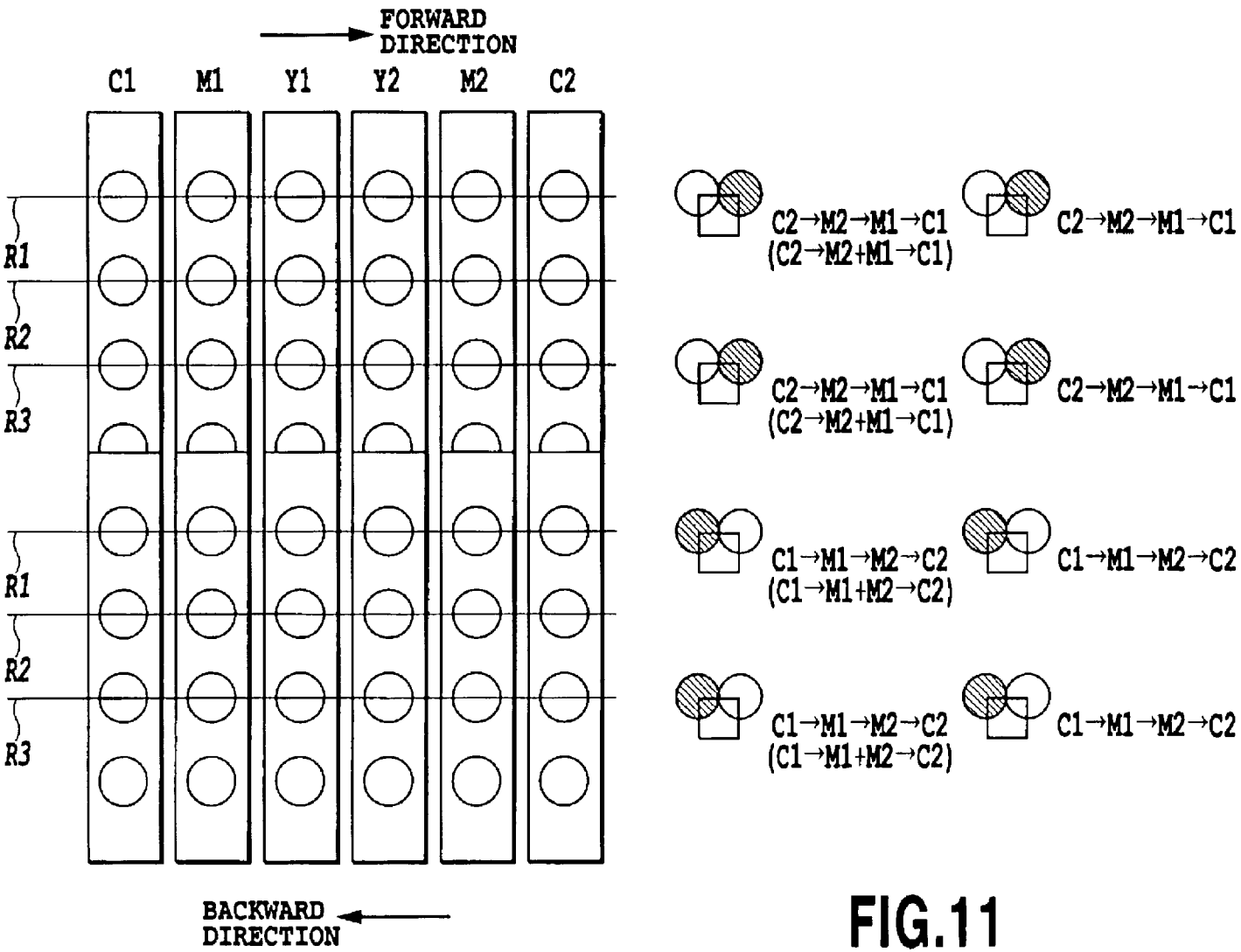
FIG. 11 is a view showing how a high-density area is printed using the first basic construction of the embodiment of the present invention.

FIGS. 10 and 11 show bidirectional printing according to this embodiment. In this embodiment, the distribution circuit 207, described previously, distributes dots to be arranged to respective color data, as shown in FIGS. 9A to 9C. In FIGS. 9A to 9C, dots are arranged at positions offset from each other in the main-scanning direction, but the present invention is not limited to this method. The dot on dot arrangement or other offset positions may be used.

FIG. 9A shows the relationship between input data for cyan (C) and the arrangement of dots. No dots are arranged for cyan data 00. For data 01, data is stored in the print buffer 205C1 in FIG. 7 or in the print buffer 205C2 to cause the distribution circuit 207 to achieve substantially an equal appearance rate. Then, for the data 01, the dot is arranged in either of the two ways shown at 01 in FIG. 9A.

For largest data 01, two dots are arranged, so that the data is arranged in each of the print buffers 205C1 and 205C2, and the dots are arranged in the way shown at 10 in FIG. 9A.

FIG. 9B shows the relationship between input data for magenta (M) and the arrangements of dots. However, this relationship is similar to that of cyan, and description thereof is thus omitted.

FIG. 9C shows the relationship between input data for blue, a secondary color, and the positions of dots. Since the above-described primary color (cyan and magenta) does not involve the concept of the landing order, it undergoes no difference in coloring. However, with the secondary color, a difference in coloring may occur, and the landing order is important.

FIG. 9C shows input data for blue, but actually shows that signal values of 00, 01, and 10 are equally input for each of cyan and magenta.

With the input data 00, no dots are arranged. With the data 01, a dot can be arranged in either of the four ways shown in FIG. 9C. With the data 01, the distribution circuit 207 distributes C and M dots so as to form four combinations in each of the forward and backward directions. In the simplest system, the four combinations are directly used to reproduce the data 01.

In this distribution, the data may be sequentially distributed to a plurality of (in this case, two) buffers or may be randomly distributed. It suffices to preclude the ink application orders for a plurality of pixels in the raster direction from being one-sided. Desirably, for the above reasons, it is ideal to allow the ink application orders to appear at substantially the same rate.

To reduce the inter-dot distance in the image to increase the spatial frequency in order to restrain the image from appearing rough, or to prevent the dots from entirely overlapping each other and being conspicuous, or to reduce uneven stripes, the system may be altered so that the distribution circuit 207 checks the appearance of each of C, M, and Y for each pixel so as to prevent the dots from overlapping each other.

With the data 10, different combinations are provided for the forward and backward directions. However, for each pixel, the landing order is the same, so that the same coloring can be obtained.

In FIGS. 9A to 9C, dots for cyan, magenta, and blue, which is a secondary color of cyan and magenta, have been described, but this description is also applicable to yellow and other secondary colors, green and red.

FIG. 10 shows that bidirectional printing is carried out using the reproduction method of this embodiment if cyan and magenta are evenly contained in designated pixels according to the data 01. In this state, the landing order is revered in each column in both the forward and backward directions (C2→M2 and M1→C1), thereby enabling substantially even colors to be reproduced from a macroscopic viewpoint.

FIG. 11 shows that bidirectional printing is carried out using the reproduction method of this embodiment if cyan and magenta are evenly contained in designated pixels according to the data 10. In this state, the landing order is identical (symmetrical) in both the forward and backward directions, thereby enabling substantially even colors to be reproduced.

(Second Basic Construction)

Figure 12:
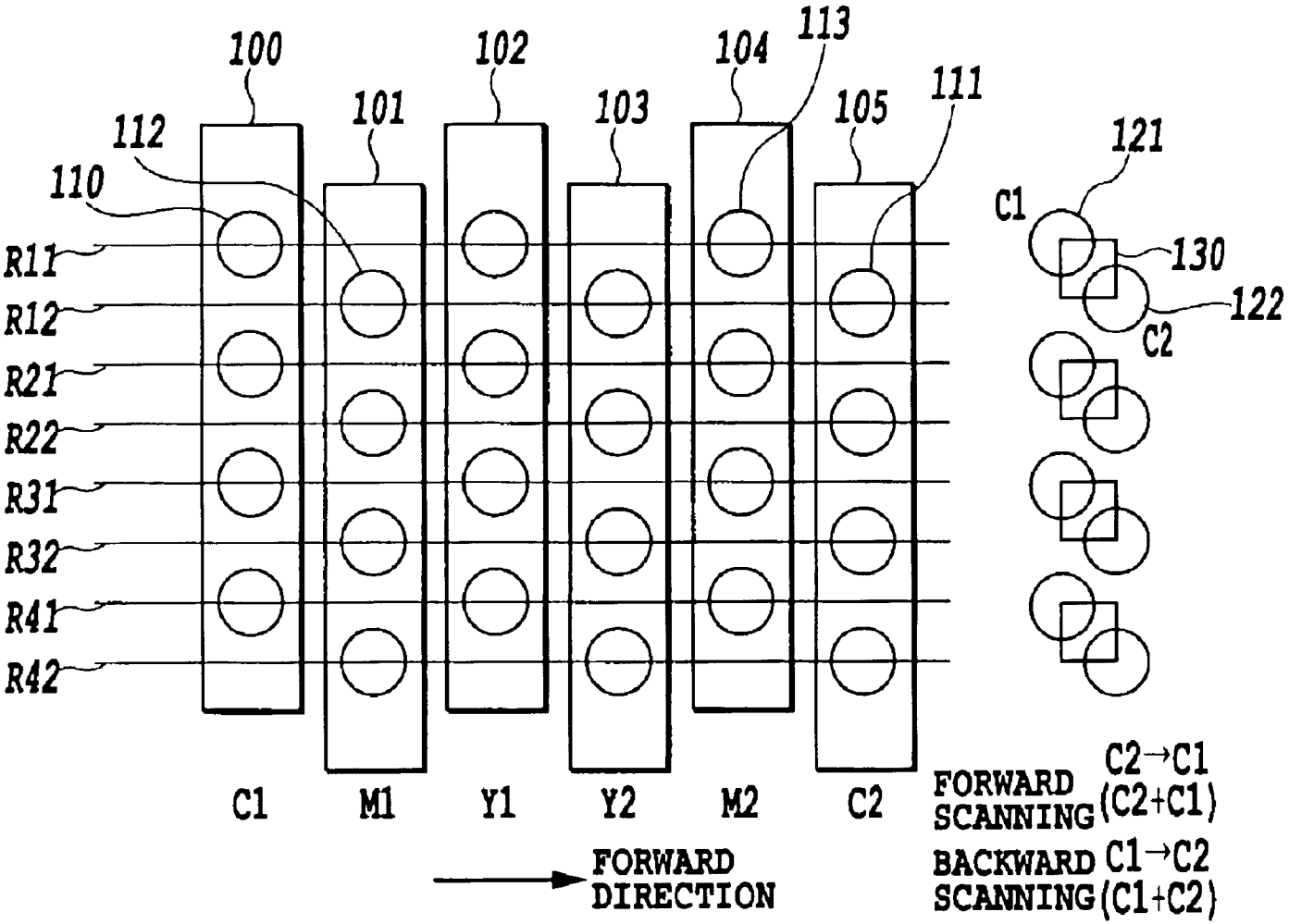
FIG. 12 is a view showing a configuration of print heads and nozzles and an arrangement of pixels according to a second basic construction of the embodiment of the present invention.

FIG. 12 is a schematic view partially showing a second basic construction of an essential part of the print head section of the head cartridge 1. The components in this figure are similar to those of the print head section in FIG. 3. However, the construction of the print head section used in this embodiment differs from that in FIG. 3 in that a pair of print heads for the same color which constitute pixels of this color are shifted in the sub-scanning direction a distance corresponding to half of the pitch of the nozzles of the print heads.

FIG. 12 shows that the prime color of cyan is printed using the above construction. This figure shows that a pair of two dots at dot positions 121 and 122 are printed on the pixel 130 in order to obtain the maximum density thereof. The dot positions 121 and 122 in this figure show where a dot ejected through the nozzle 110 of the print head 100C1 and a dot ejected through the nozzle 111 of the print head 105C2 are arranged in the area of the pixel 130. In this case, the dot position 121 shows an upper left diagonal position of the figure, whereas the dot position 122 shows an lower right diagonal position thereof. Further, reference characters R11 and R12 denote main-scanning lines forming the pixel 130, that is, rasters. Here, two rasters form one pixel.

Figure 13:
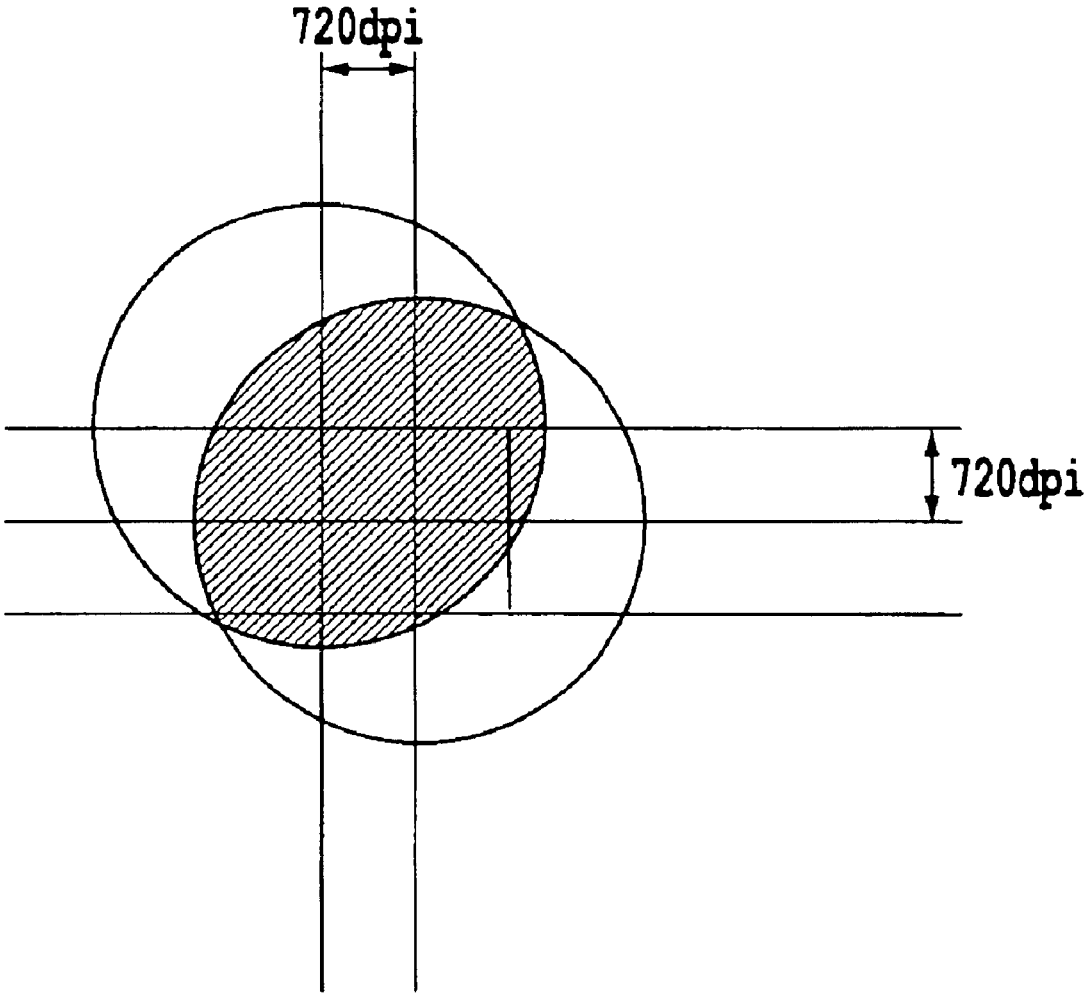
FIG. 13 is a view showing how dots in the arrangement of the pixels overlap each other.

In this case, if the direction shown by an arrow in FIG. 12 and in which the head cartridge 1 is moved is defined as forward, then in the forward direction, a dot from the print head 105C2 and then a dot from the print head 100C1 land on the pixel 130. In the backward direction, a dot from the print head C1 and then a dot from the print head C2 land on the pixel 130. However, in the case of the primary color, the same color lands on the pixel in both directions, so that there will be no difference in coloring associated with the landing order. In this figure, the dot positions 121 and 122 are not shown to overlap each other, but the dots normally partially overlap each other as shown in FIG. 13.

Figure 14:
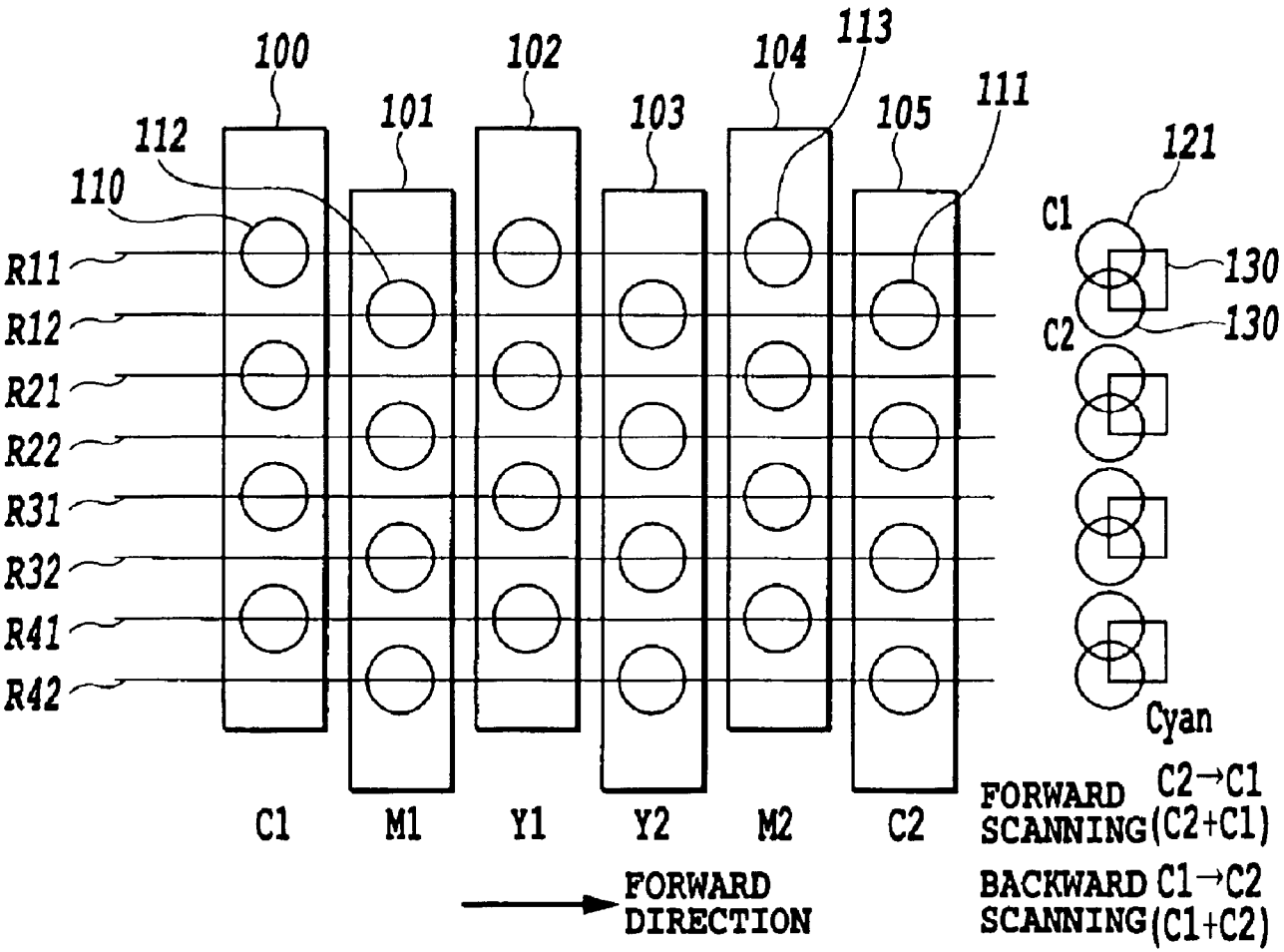
FIG. 14 is a view showing another example of the configuration of the print heads and nozzles and the arrangement of the pixels.

FIG. 14 shows that dots are arranged at the dot positions 121 and 123 on the pixel 130 using the head cartridge 1 constructed in the same manner as in FIG. 12. Also in this case, since the dots of the same primary color are arranged, no difference in coloring occurs between the forward and backward directions.

Figure 15:
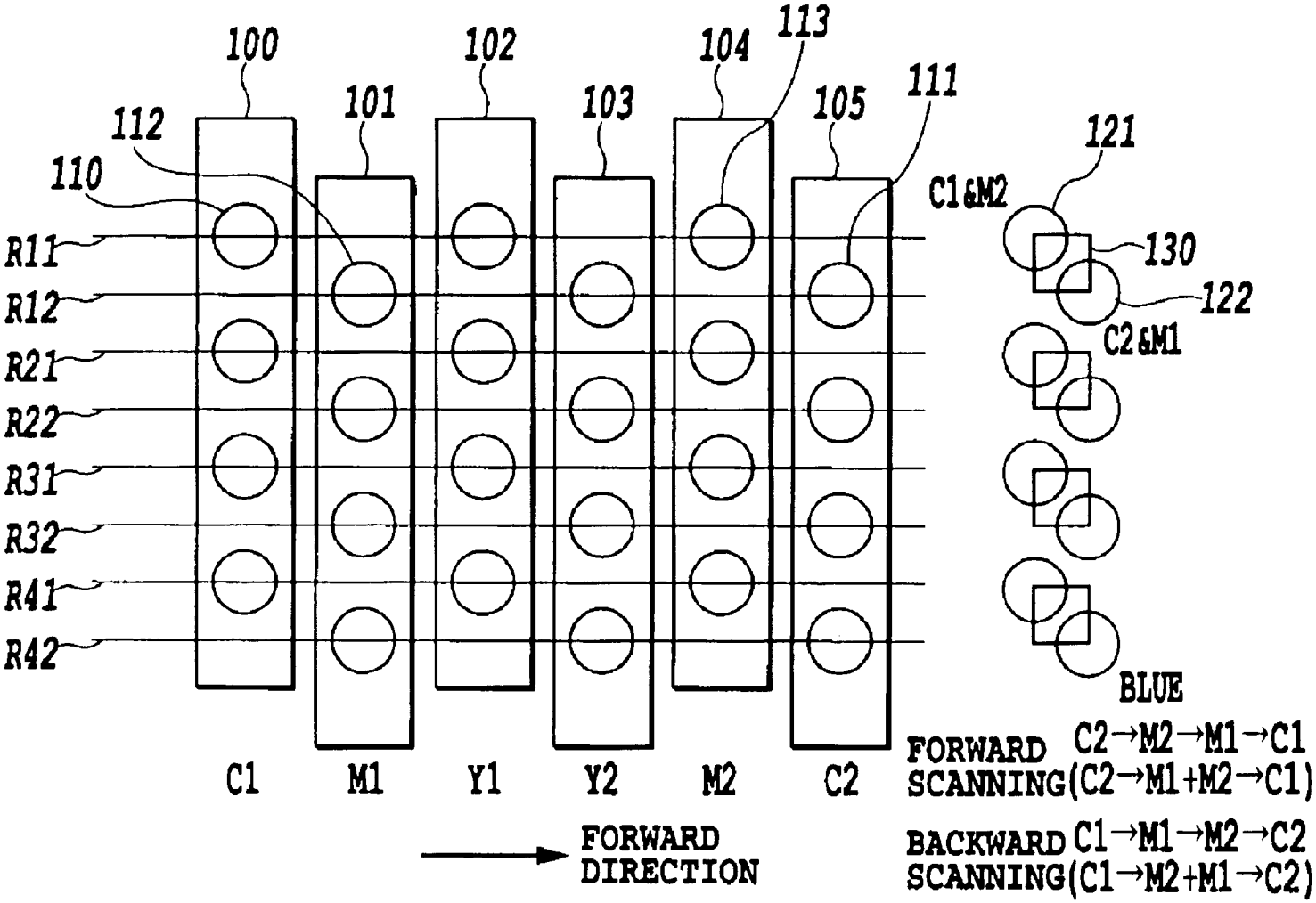
FIG. 15 is a view showing yet another example of the configuration of the print heads and nozzles and the arrangement of the pixels.

FIG. 15 shows that a cyan and a magenta dots are arranged at the dot positions 121 and 122 on the pixel 130 using the head cartridge 1 constructed in the same manner as in FIG. 12. In this case, in contrast to the arrangement of the pixel 130 in FIG. 12, the inks of the respective colors form a dot on dot arrangement on the corresponding pixel arrangement. As in FIG. 6 for Embodiment 1, the pixel 130 always exhibits an even coloring characteristic.

From a microscopic viewpoint, the pixels with different coloring are alternately arranged in the respective rasters. From a macroscopic viewpoint, in the forward direction, the dots are applied to the pixel 130 in the order of the cyan dot from the head C2, the magenta dot from the head M2, the magenta dot from the head M1, and the cyan dot from the head C1. In the backward direction, the dots are applied to the pixel 130 in the order of the cyan dot from the head C1, the magenta dot from the head M1, the magenta dot from the head M2, and the cyan dot from the head C2. Thus, for each pixel, even intermediate blue can be obtained.

As described above, in realizing the concepts of the present invention, it is essential to ensure that the colors constituting a pixel predominantly land on the pixel in a symmetrical order between the forward and backward printing in order to obtain the maximum density of the pixel. Thus, as in Embodiment 1, the pixel 130 can always exhibit an even coloring characteristic.

As described above, in implementing of the present invention, it is important to ensure that the colors forming the secondary color constituting a pixel predominantly land on the pixel in a symmetrical order between the forward and backward printing in order to obtain the maximum density of the pixel. In this example, the secondary color is illustrated as blue (cyan and magenta), but it is easily appreciated that the above description also applies to red (magenta and yellow) or green (cyan and yellow).

Figure 16:
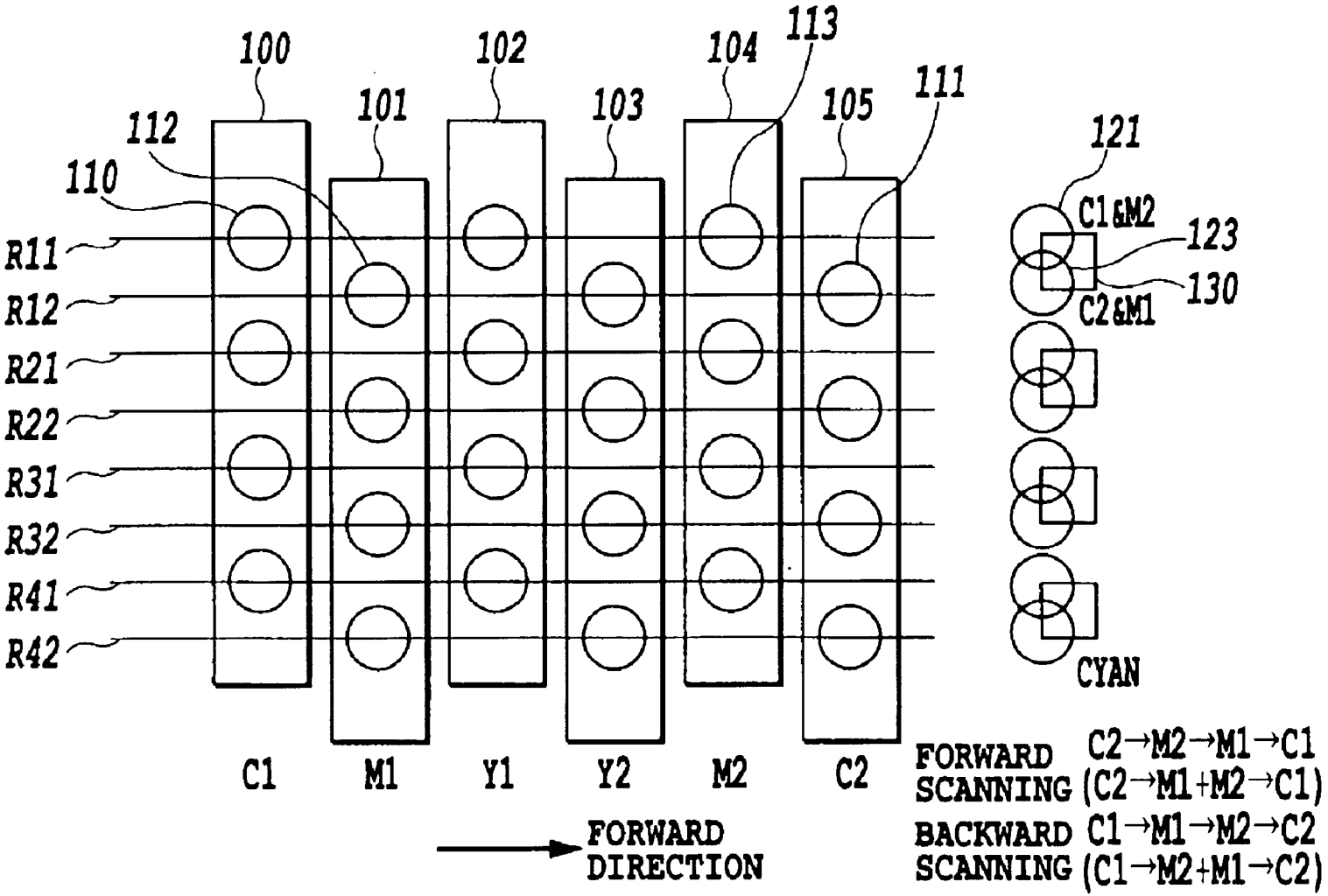
FIG. 16 is a view showing still another example of the configuration of the print heads and nozzles and the arrangement of the pixels.

FIG. 16 shows that inks for the respective colors from a dot on dot arrangement on the dot positions 121 and 123 on the pixel 130 using the head cartridge 1 constructed in the same manner as in FIG. 3. Also in this state, the pixel 130 can always exhibit an even coloring characteristic, as in FIG. 15.

The reproduction of the maximum density for each pixel has been principally described, but an explanation will be given of the reproduction of bidirectional printing in the case in which a half tone is reproduced within a pixel. Here, a specific example will be given in which multivalued data is received. The multivalued data and a change in landing order are similar to those in the above embodiment, and description thereof is thus omitted.

Figure 17:
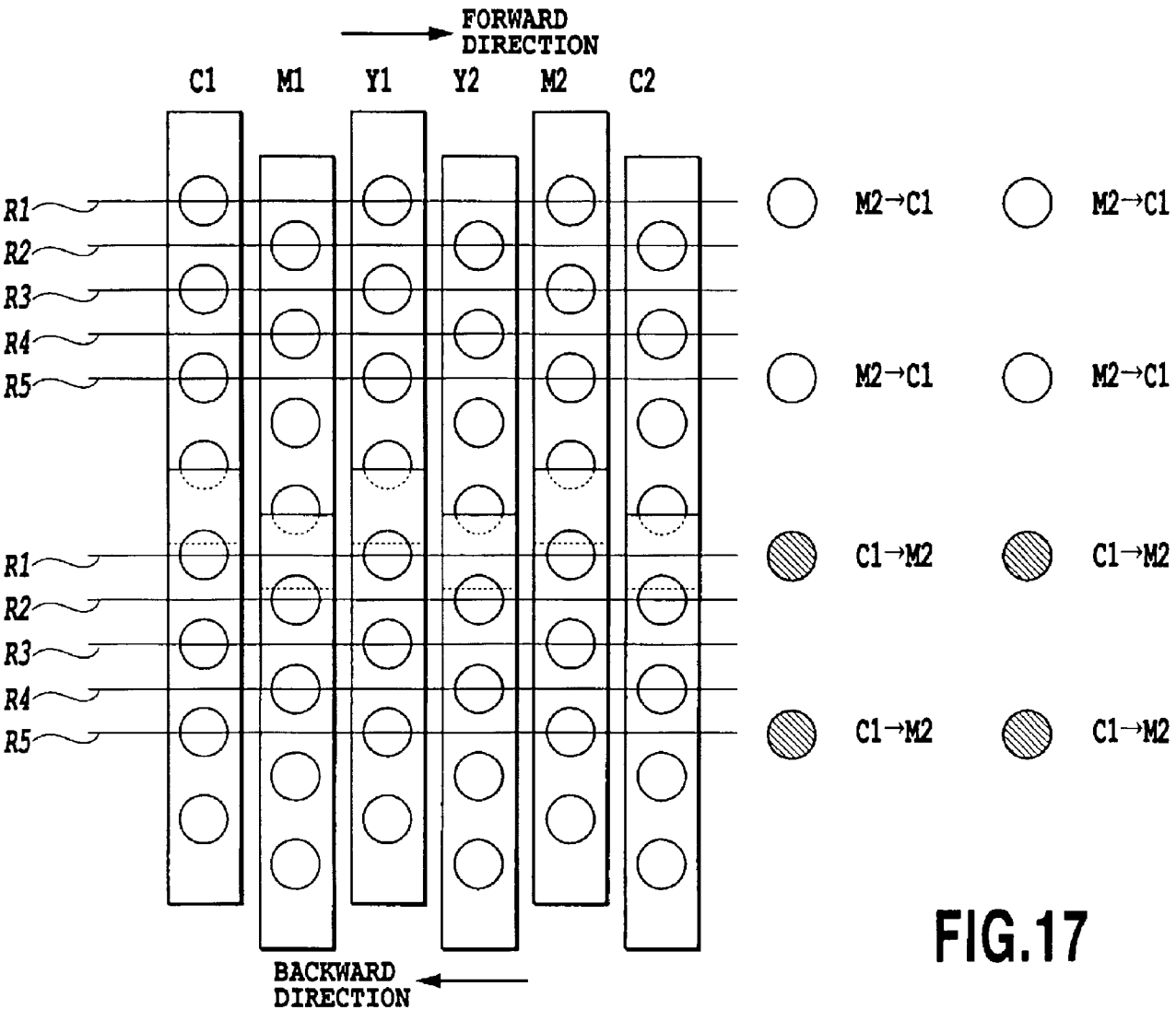
FIG. 17 is a view showing the principle of the occurrence of uneven colors due to interference among data during bidirectional printing in a conventional example.

FIG. 17 shows a conventional example of the yielding of print nozzles used associated with the yielding of print data to the positions of the print nozzle rows during repciprocative printing. This figure shows the hue of dots arranged in a certain column if a halftone area, horizontal ruled lines, or a hatched area with a certain arrangement of blue (cyan and magenta) dot data is printed in the rasters R1 to R5.

In the forward direction, the magenta (M) ink is first ejected, and the cyan (C) is then ejected. In the backward direction, these inks are ejected in the reverse order. Thus, only with symmetrically arranged print heads for yellow, magenta, and cyan, a difference in hue may still occur between the forward and backward directions depending on the type of print data.

That is, as seen in the figure, when blue (cyan and magenta) is formed, dots undergoing the same landing order are created in each of the forward and backward directions. Since these landing orders differ from each other, a band-like unevenly colored portion occur in the scanning direction.

Figure 18A:
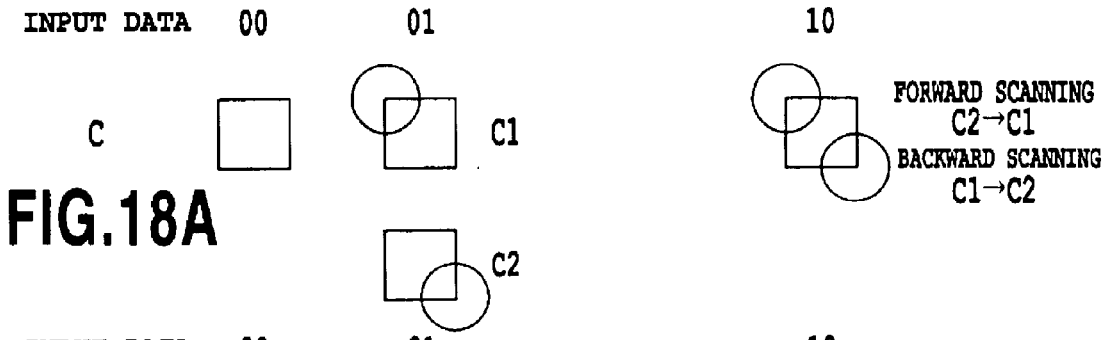
FIGS. 18A to 18C are views showing the relationship between input data used in the second basic construction of the embodiment of the present invention and the positions of arranged dots.
Figure 18B:
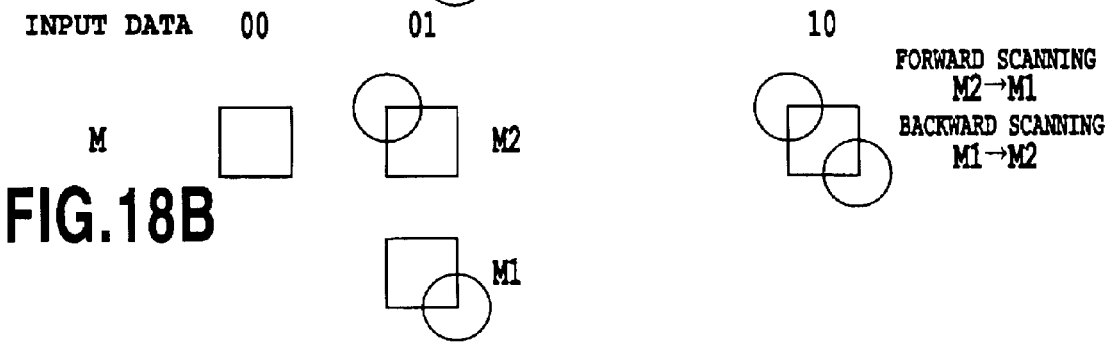
Figure 18C:
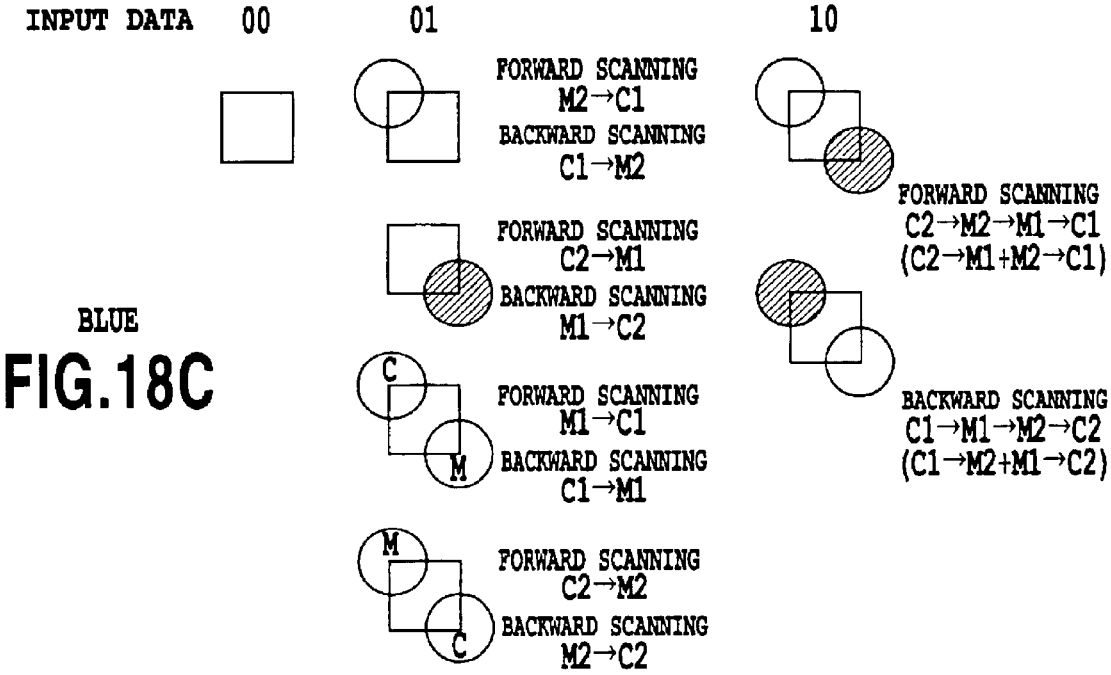
Figure 19:
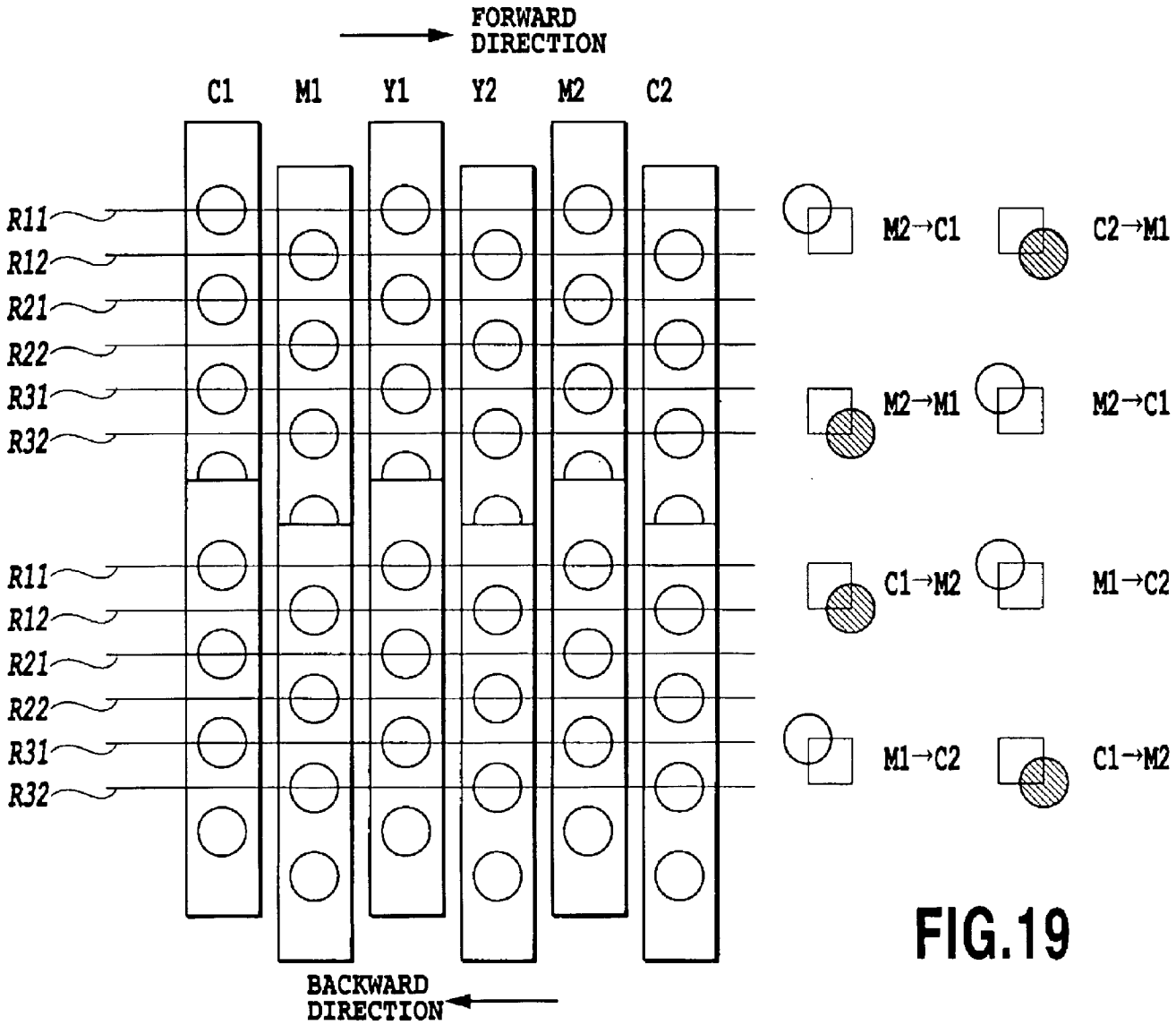
FIG. 19 is a view showing how a low-density area is printed using the second basic construction of the embodiment of the present invention.
Figure 20:
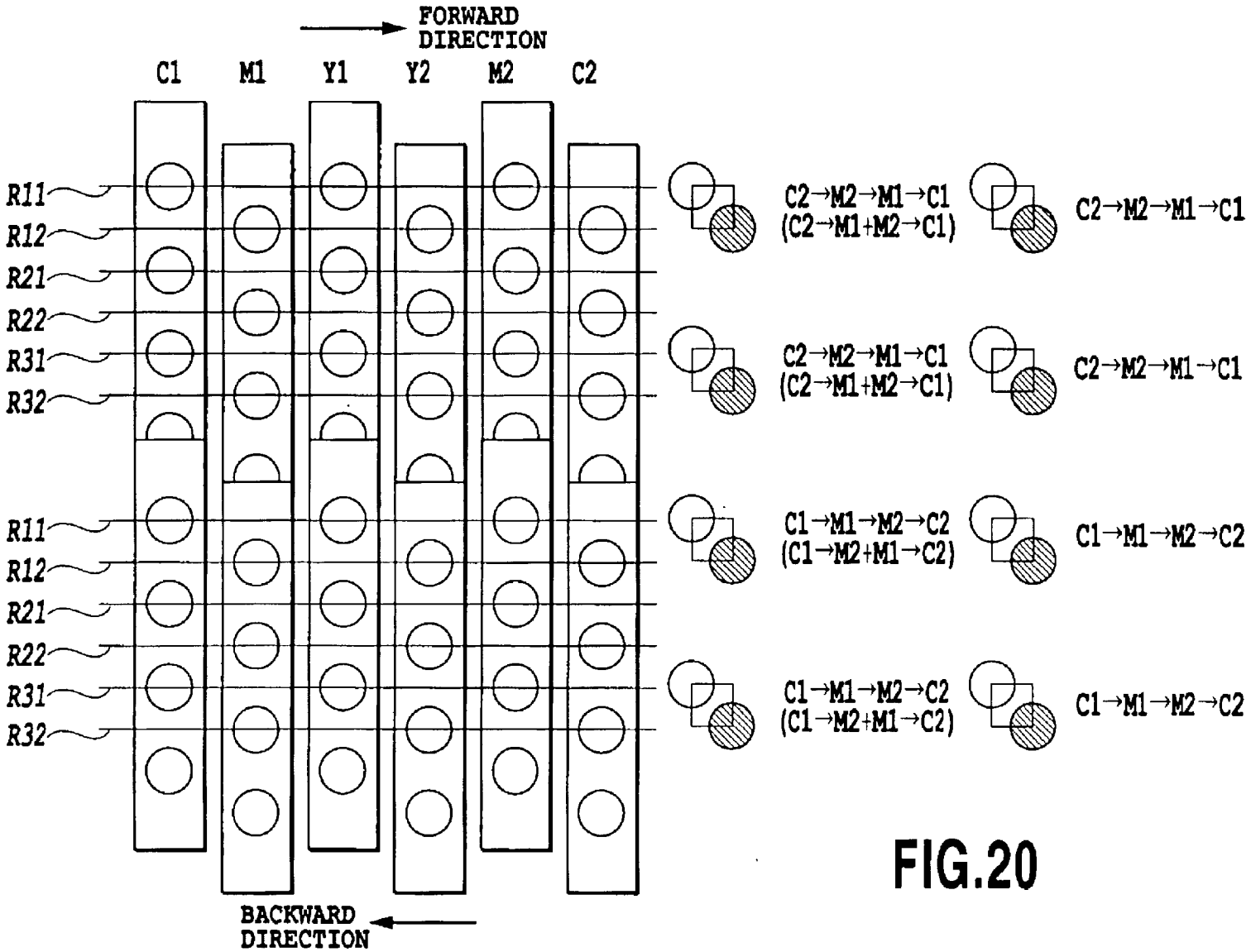
FIG. 20 is a view showing how a high-density area is printed using the second basic construction of the embodiment of the present invention.
Figure 21A:
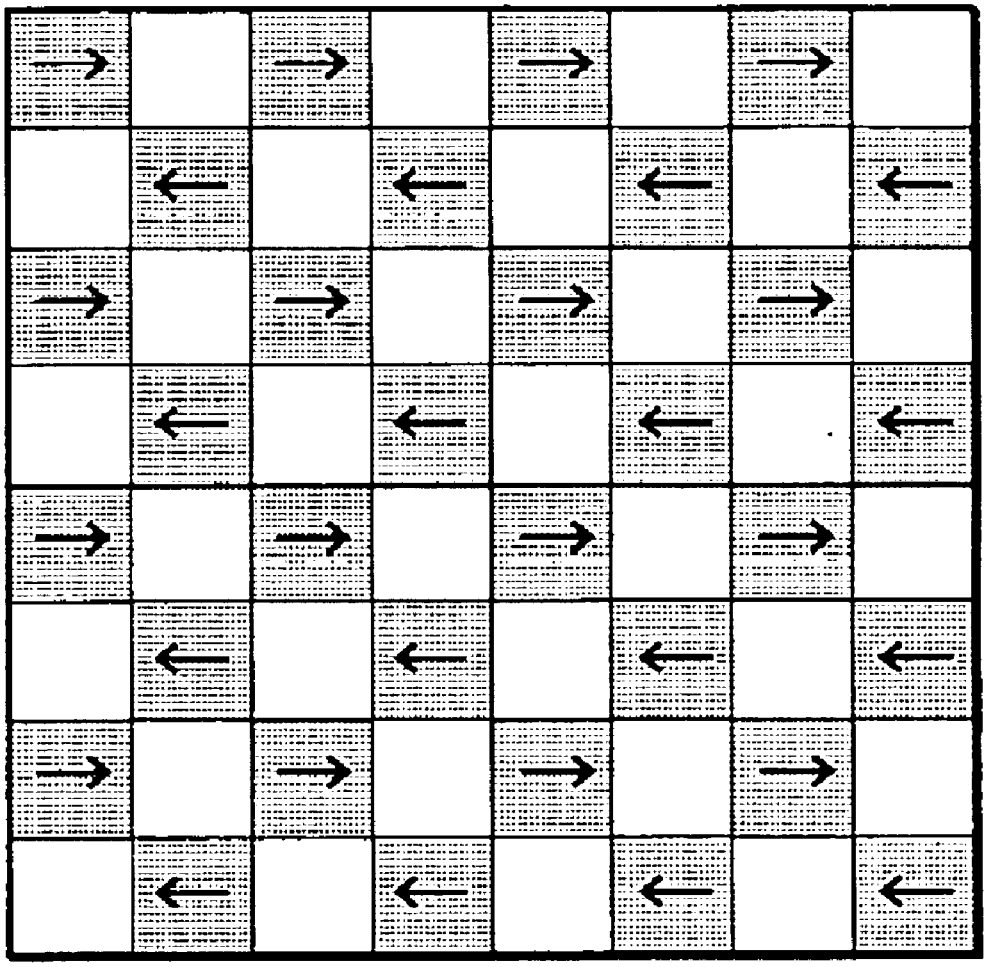
Figure 22A:
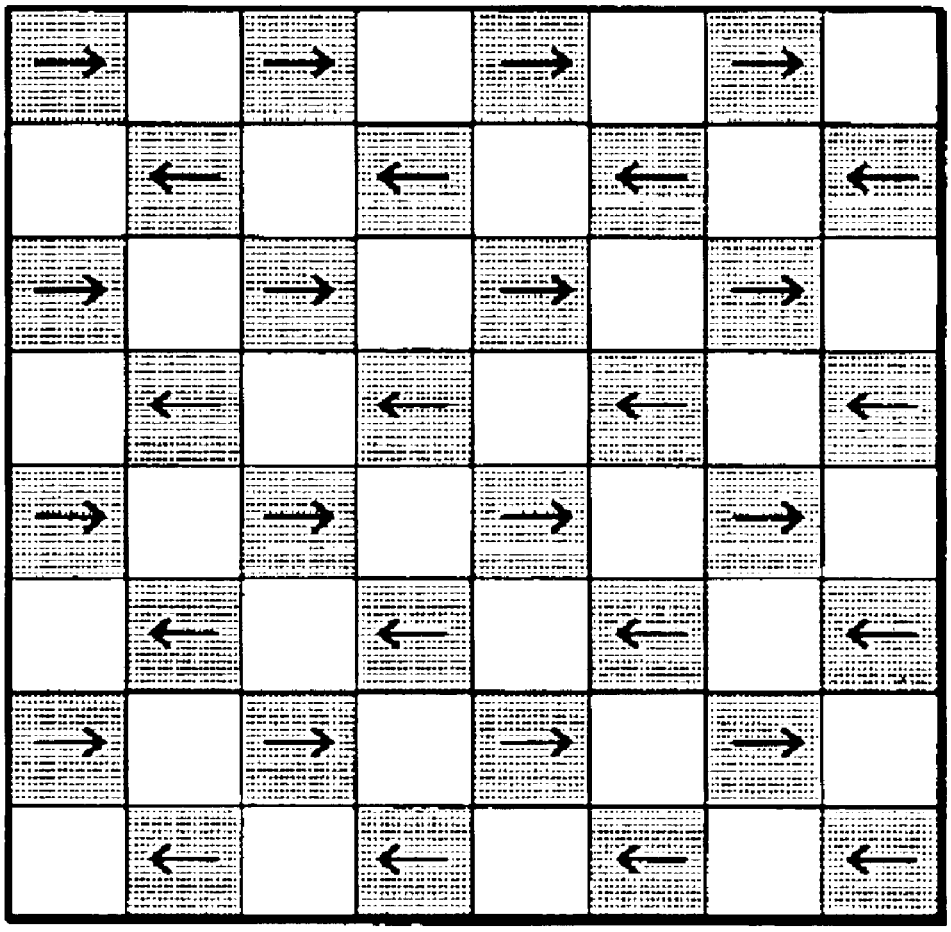

FIGS. 19 and 20 show bidirectional printing according to this embodiment. In this embodiment, the distribution circuit 207, described previously, distributes dots to be arranged for respective color data, as shown in FIGS. 18A to 18C. The dot distribution in FIGS. 18A to 18C is similar to that in FIGS. 9A to 9C, and description thereof is thus omitted. The arrangement of the magenta print heads M1 and M2 in FIGS. 18A to 18C is offset from that in FIGS. 9A to 9C by half the dot pitch, so that the relationship between the heads and the dot positions is reverse compared to FIGS. 9A to 9C.

In FIGS. 18A to 18C, dots for cyan, magenta, and blue, which is a secondary color of cyan and magenta, have been described, but this description is also applicable to yellow and other secondary colors, green and red.

FIG. 19 shows that bidirectional printing is carried out using the reproduction method of this embodiment if cyan and magenta are evenly contained in designated pixels according to the data 01. In this state, the landing order is revered in each column in both the forward and backward directions (C2→M2 and M1→C1), thereby enabling substantially even colors to be reproduced from a macroscopic viewpoint.

FIG. 20 shows that bidirectional printing is carried out using the reproduction method of this embodiment if cyan and magenta are evenly contained in designated pixels according to the data 10. In this state, the landing order is identical (symmetrical) in both the forward and backward directions, thereby enabling substantially even colors to be reproduced.

[Characteristic Constructions of the Invention]

The characteristic constructions of the present invention will be described below with reference to first to third variations of the embodiment. In the first to third variation, the construction of the mechanical section of the ink jet printing apparatus, the configuration of the control circuit, and other arrangements are similar to those described in the above-described basic constructions. However, these variations differ from the above basic construction in that it employs what is called multipass printing method of forming a color image by scanning the same scanning area a plurality of times in a forward and a backward directions using different nozzle groups of the print heads to apply ink of a plurality of colors to a print medium.

(First Variation)

The first variation of the embodiment will be described below with reference to FIGS. 12 to 21.

In this embodiment, print heads such as the ones shown in FIG. 12 are used, raster mask patterns A and B (see FIG. 21B) set in the data masking circuit 208 are used, and a thinning process is executed for multipass printing of an image signal. That is, an image is printed by dividing image data into two in the column direction using the even raster mask A and the odd raster mask B and masking each of the divided image data in the raster direction on the basis of a predetermined duty ratio.

For simplified explanation, if 8×8 blue pixels are to be formed during four scanning operations (four passes are to be executed), then in the first print scanning (forward scanning) of input data, only 50% of the image data for odd rasters is printed (25% duty in total), and 50% of the image data for even rasters is then printed. Subsequently, the remaining 50% image signal for the odd rasters is printed to complete one image. In this case, 1×1 staggered masks (hereinafter referred to as "fine masks") are used for the 50% decimation.

In this bidirectional scanning, the print medium is transported a distance equal to a value determined by dividing the print head length by the number of passes, that is, 25% of the length in this case.

In this printing operation, when the odd rasters are to be printed, scanning is carried out in the forward direction (from left to right in the figure). When the even rasters are to be printed, scanning is carried out in the backward direction (from right to left in the figure) At this time, with the symmetrical print heads shown in FIG. 12, the odd rasters are formed using the printing elements M2 and C1 during the forward scanning. The even rasters are formed using the printing elements M1 and C2 during the backward scanning.

Accordingly, for any raster, the magenta dots land on the print medium before the cyan dots (see FIG. 21C), and all the dots can be formed so as to provide the same coloring, thereby forming an image without any uneven colors. In this case, the landing order is fixed without the need to distribute the data, thereby enabling the formation of an image without any uneven colors. In this variation, the raster masks which thin raster direction data are used, but even with column masks which thin column direction data, the landing order is fixed, thereby enabling the formation of an image without any uneven colors.

(Second Variation)

The second variation of the embodiment will be described below with reference to FIGS. 22A to 22D.

Like the first variation, the second variation employs the multipass printing method, but uses staggered masks A and B set in the data masking circuit 208 instead of the raster masks used in the first variation.

In this variation, the staggered masks are of 2×2 size (see FIG. 22B). In the first print scanning (forward scanning), only 50% of the image data to be masked by the staggered mask A is printed (25% duty in total), and 50% of the image data to be masked by the staggered mask B. Again, the fine masks are used to set the duty at 25%. Subsequently, the remaining 50% of the image data for the staggered mask A is printed, and the remaining 50% of the image data for the staggered mask B is finally printed to complete one image. In this bidirectional scanning, the print medium is transported a distance equal to a value determined by dividing the print head length by the number of passes, that is, 25% of the printing width of the print head in this case.

According to this method, even with the fixed masks, the rasters can be formed during four passes, thus hindering the creation of uneven stripes associated with dot mis-alignment from the print heads. From a microscopic viewpoint, the landing order varies for each raster to form blue dots with different coloring. However, from a macroscopic viewpoint, an image with uniform coloring is obtained in which the colors appear relatively even. Further, with the data 01, if dots with a different landing order appear at a different rate in a certain area owing to their yielding to the patterns, a large color difference may occur even if the same color is designated. This problem is solved by using the distribution circuit 207 to randomly distribute the print data.

(Third Variation)

Now, the third variation of the embodiment of the present invention will be described.

Figure 23A:
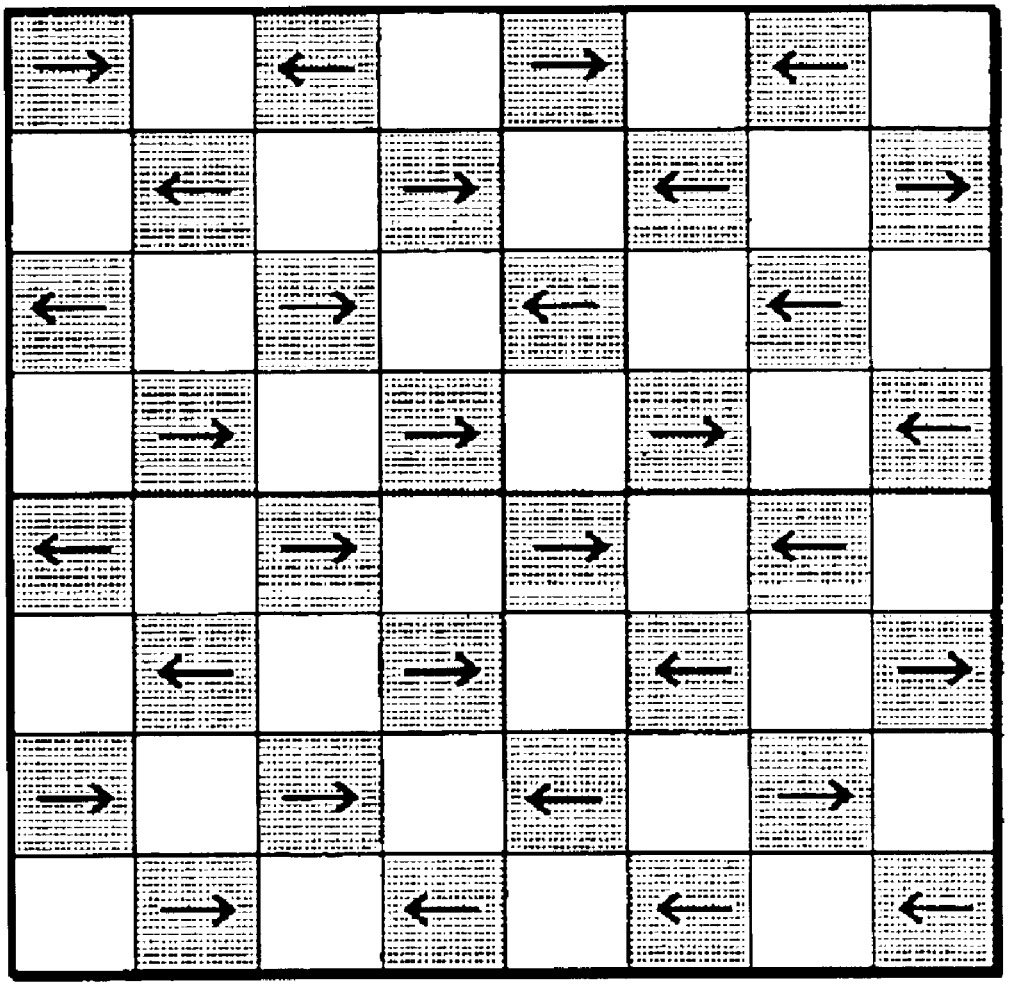

In the third embodiment, random masks such as the ones shown in FIG. 23B are used instead of the raster or staggered masks shown in the first or second variation, respectively. In these random masks, "1" indicates pixels printed during the first scanning, "2", pixels printed during the second scanning, "3", pixels printed during the second scanning, and "4", pixels printed during the second scanning. Each scanning operation has a duty of 25%.

According to the third variation, the rasters can be formed during four passes compared to two passes during which the rasters are printed according to the first basic construction. This hinders the creation of uneven stripes associated with dot mis-alignment from the print heads and prevents uneven colors associated with the landing order by making the coloring even using the distribution effect based on the randomization. Also in this case, the random masks serve to arrange a secondary color in the raster direction using different landing orders, thereby preventing the occurrence of uneven colors from a macroscopic viewpoint.

As described above, the present invention provides a printing apparatus employing the multipass printing apparatus and which can reduce the unevenness of colors occurring during the directional printing in connection with the ink application order.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A print apparatus comprising print heads having a plurality of printing element rows, each of said printing element rows having a plurality of printing elements to form a color image by scanning the same scanning area a plurality of times in a forward and a backward direction using different printing element rows of the print heads to apply ink of a plurality of colors to a print medium, wherein the print heads include two sets of printing element array sections, each of said array sections having printing element rows, the sets being sequentially arranged and capable of ejecting different inks, the arrays of the printing element rows of the printing element array sections being symmetrical in a scanning direction, wherein the print apparatus comprises:

a change means for changing an ink application order to apply a plurality of color inks onto pixel areas that form a secondary color by distributing image data to said two sets of printing element array sections; and a mask means for complementarily masking predetermined rasters in a raster direction or predetermined columns in a column direction while scanning image data a plurality of times, wherein said mask means masks the image data distributed by said change means so as to form an image by a plurality of scans.

2. The print apparatus according to claim 1, wherein said change means distributes the image data into the two sets of printing element array sections so that an ink application order of a plurality of color inks for at least one of a plurality of the pixel areas differs from an ink application order of the plurality of color inks for another secondary color pixel area arranged in a column direction.

3. The print apparatus according to claim 2, wherein said change means changes the ink application order for substantially half of the pixel data which is not masked by said mask means.

4. The print apparatus according to claim 2, wherein said change means changes the ink application order for the pixel area by selecting from the symmetrically arranged plurality of printing elements.

5. The print apparatus according to claim 2, wherein said change means has a plurality of print buffers corresponding to the symmetrically arranged plurality of printing elements, and by selectively storing print data in the plurality of print buffers to apply ink from corresponding printing elements, changes an ink application order for at least one of a plurality of secondary color pixel areas arranged in each raster, compared to an ink application order for the other secondary color pixel areas and then forms said secondary color pixel area.

6. The print apparatus according to claim 5, wherein by distributing the print data to the plurality of print buffers on the basis of image signals corresponding to a color image, said change means changes the ink application order for at least one of the plurality of secondary color pixel areas arranged in each raster, compared to the ink application order for the other secondary color pixel areas and then forms the secondary color pixel area.

7. The print apparatus according to claim 6, wherein said change means sequentially distributes the print data to the plurality of print buffers on the basis of the image signals corresponding to the color image.

8. The print apparatus according to claim 2, wherein the print heads each have printing elements arranged in the scanning direction for applying ink of a plurality of colors, and said change means changes the ink application order for the pixel area by selecting the scanning direction of the print heads to apply the ink to the pixel area.

9. The print apparatus according to claim 2, further comprising application means for applying one of a plurality of color inks applied to form a secondary color, to a pixel area for the secondary color a plurality of times so that the application order for the one color ink and the application order for the other color ink are symmetrical.

10. The print apparatus according to claim 9, wherein the other color ink is applied to the pixel area a plurality of times.

11. The print apparatus according to claim 10, wherein a plurality of secondary color dots formed of the one color ink and the other color ink applied in different orders are arranged on the pixel area.

12. The print apparatus according to claim 9, wherein dots formed of the plurality of color inks applied to the pixel area have substantially the same center of gravity.

13. The print apparatus according to claim 9, wherein the dots formed of the plurality of color inks applied to the pixel area partially overlap each other.

14. The print apparatus according to claim 1, wherein said mask means masks either odd or even columns or either odd or even rasters.

15. The print apparatus according to claim 14, wherein said change means changes an ink application order for pixel data corresponding to substantially half of a plurality of secondary pixel areas arranged in the column direction or the raster direction.

16. The print apparatus according to claim 1, wherein the print heads have printing elements that apply at least cyan, magenta, and yellow inks and that are arranged so that printing elements corresponding to one color and printing elements corresponding to another color are symmetrical in the scanning direction.

17. The print apparatus according to claim 16, wherein the print heads have sets of two printing elements each that apply at least cyan, magenta, and yellow inks and that are arranged so as to be symmetrical in the scanning direction.

18. The print apparatus according to claim 17, wherein the print heads further include printing elements that apply black ink.

19. The print apparatus according to claim 16, wherein the print heads further include printing elements that apply black ink.

20. The print apparatus according to claim 1, wherein the print heads thermally eject ink.

21. A print apparatus comprising print heads having a plurality of printing element rows, each of said printing element rows having a plurality of printing elements to form a color image by scanning the same scanning area a plurality of times in a forward and a backward direction using different printing element rows of the print heads to apply ink of a plurality of colors to a print medium, wherein the print heads include two sets of printing element array sections, each of said printing element array sections having printing element rows, the sets being sequentially arranged and ejecting different inks, the arrays of the printing element rows of the printing element array sections being symmetrical in a scanning direction, wherein the print apparatus comprises:

a change means for changing an ink application order for at least one of a plurality of secondary color pixel areas arranged in a column direction, compared to an ink application order for the other secondary color pixel areas, to form said secondary color pixel area;

a mask means for complementarily masking predetermined rasters in a raster direction or predetermined columns in the column direction while scanning image data a plurality of times; and a recording control means for forming an image by a plurality of scans of the print heads onto the same scanning area in accordance with the image data masked by said mask means, wherein said mask means masks an image data after being changed by said mask means to generate image data corresponding to each of the plurality of scans.

22. A print apparatus comprising print heads having a plurality of printing element rows, each of said printing element rows having a plurality of printing elements to form a color image by scanning the same scanning area a plurality of times in a forward and a backward direction using different printing element rows of the print heads to apply ink of a plurality of colors to a print medium, wherein the print heads include two sets of printing element array sections, each of said printing element array sections having printing element rows, the sets being sequentially arranged and ejecting different inks, the arrays of the printing element rows of the printing element array sections being symmetrical in a scanning direction, wherein the print apparatus comprises:

a change means for changing an ink application order to apply a plurality of color inks onto pixel areas that form a secondary color by distributing image data to the two sets of printing elements array sections; and a mask means for complementarily masking predetermined rasters in a raster direction or predetermined columns in a column direction while scanning image data a plurality of times, wherein said mask means masks the image data distributed by said change means so as to form an image by a plurality of scans.

23. The print apparatus according to claim 22, wherein said change means randomly distributes the print data to the plurality of print buffers on the basis of image signals corresponding to an image signal.

24. A print method comprising print heads having a plurality of printing element rows, each of the printing element rows having a plurality of printing elements to form a color image by scanning the same scanning area a plurality of times in a forward and a backward direction using different printing element rows of the print heads to apply ink of a plurality of colors to a print medium, wherein the print heads include two sets of printing element array sections, each of the array sections having printing element rows, the sets being sequentially arranged and ejecting different inks, the arrays of the printing element rows of the printing element array sections being symmetrical in a scanning direction, wherein the print method comprises:

a change step, of changing an ink application order to apply a plurality of color inks onto pixel areas that form a secondary color by distributing image data to the two sets of printing element array sections; and a mask step, of complementarily masking predetermined rasters in a raster direction or predetermined columns in a column direction while scanning image data a plurality of times, and wherein said mask step masks the image data distributed in said change step so as to form an image by a plurality of scans.

25. A print method comprising print heads having a plurality of printing element rows each, of the printing element rows having a plurality of printing elements to form a color image by scanning the same scanning area a plurality of times in a forward and a backward direction using different printing element rows of the print heads to apply ink of a plurality of colors to a print medium, wherein the print heads include two sets of printing element array sections, each of the printing element array sections having printing element rows, the sets being sequentially arranged and ejecting different inks, the arrays of the printing element rows of the printing element array sections being symmetrical in a scanning direction, wherein the print method comprises:

a change step, of changing an ink application order for at least one of a plurality of secondary color pixel areas arranged in a column direction, compared to an ink application order for the other secondary color pixel area, to form the secondary color pixel area, and a mask step, of complementarily masking predetermined rasters in a raster direction or predetermined columns in a column direction while scanning image data a plurality of times, a recording control step, of forming an image by a plurality of scans of the print heads onto the same scanning area in accordance with the image data masked in said mask step, wherein said mask step masks an image data after being changed in said mask step to generate image data corresponding to each of the plurality of scans.

26. The print method according to claim 25, wherein the print heads have sets of two printing elements that apply a plurality of inks, the sets being arranged symmetrically in the scanning direction, and said change step and said mask step are executed during a single scanning operation of the print heads.

* * * * *

UNITED STATES PATENT AND TRADEMARK OFFICE

CERTIFICATE OF CORRECTION

PATENT NO. : 6,827,424 B2
DATED : December 7, 2004
INVENTOR(S) : Minoru Teshigawara et al.

It is certified that error appears in the above-identified patent and that said Letters Patent is hereby corrected as shown below:

Drawings,
SHEET 3, FIGURE 3, "FAORWARD" should read -- FORWARD --.
SHEET 4, FIGURE 4, "FAORWARD" should read -- FORWARD --.

Column 3,
Lines 5, 42 and 59, "directions" should read -- direction --; and
Line 24, "head" should read -- heads --.

Column 4,
Line 7, "directions" should read -- direction --.

Column 9,
Line 64, "Form" should read -- From --.

Column 10,
Line 21, "dots" should read -- dot --.

Column 11,
Line 20, "spirits" should read -- spirit --; and
Line 55, "occur" should read -- occurs --.

Column 12,
Line 54, "revered" should read -- reversed --.

Column 13,
Line 5, "constitute" should read -- constitutes --; and
Line 40, "dots" should read -- dot --.

Column 14,
Line 40, "occur" should read -- occurs --; and
Line 60, "revered" should read -- reversed --.

Column 15,
Line 7, variation," should read -- variations, --; and
Line 48, "figure)" should read -- figure). --.

Column 18,
Line 37, "claim 17," should read -- claim 16, --; and
Line 40, "claim 16," should read -- claim 17, --.

UNITED STATES PATENT AND TRADEMARK OFFICE

CERTIFICATE OF CORRECTION

PATENT NO. : 6,827,424 B2
DATED : December 7, 2004
INVENTOR(S) : Minoru Teshigawara et al.

It is certified that error appears in the above-identified patent and that said Letters Patent is hereby corrected as shown below:

Column 19,
Line 28, "elements" should read -- element --.

Column 20,
Line 14, "rows each" should read -- rows, each --;
Line 32, " area," should read -- area; --;
Line 33, "and" should be deleted; and
Line 37, "times," should read -- times; and --.

Signed and Sealed this

Seventh Day of June, 2005

JON W. DUDAS
*Director of the United States Patent and Trademark Office*